US008847155B2

(12) United States Patent
Vestal

(10) Patent No.: US 8,847,155 B2
(45) Date of Patent: Sep. 30, 2014

(54) TANDEM TIME-OF-FLIGHT MASS SPECTROMETRY WITH SIMULTANEOUS SPACE AND VELOCITY FOCUSING

(75) Inventor: Marvin L. Vestal, Framingham, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 283 days.

(21) Appl. No.: 13/415,802

(22) Filed: Mar. 8, 2012

(65) Prior Publication Data

US 2012/0168618 A1 Jul. 5, 2012

Related U.S. Application Data

(63) Continuation-in-part of application No. 12/549,076, filed on Aug. 27, 2009, now abandoned, and a continuation-in-part of application No. 12/968,254, filed on Dec. 14, 2010, now Pat. No. 8,461,521, and a continuation-in-part of application No. 13/034,525, filed on Feb. 24, 2011, which is a continuation-in-part of application No. 12/968,254.

(51) Int. Cl.
*H01J 49/40* (2006.01)
*H01J 49/00* (2006.01)

(52) U.S. Cl.
CPC ..... *H01J 49/40* (2013.01); *H01J 49/004* (2013.01)
USPC ..... 250/287

(58) Field of Classification Search
USPC ..... 250/287
See application file for complete search history.

(56) References Cited

U.S. PATENT DOCUMENTS 4,960,992 A 10/1990 Vestal et al.
5,087,815 A 2/1992 Schultz et al.

(Continued)

FOREIGN PATENT DOCUMENTS

WO 00-77823 A2 12/2000
WO 2004-030025 A1 4/2004

(Continued)

OTHER PUBLICATIONS

"Notification of Transmittal of the International Search Report and the Written Opinion of the International Searching Authority, or the Declaration" for PCT/US2011/063855, Jul. 27, 2012, 11 pgs., International Searching Authority/Korea, Korean Intellectual Property Office, Daejeon Metropolitan City, Republic of Korea.

(Continued)

*Primary Examiner* — Jack Berman
*Assistant Examiner* — Eliza Osenbaugh-Stewart
(74) *Attorney, Agent, or Firm* — Kurt Rauschenbach; Rauschenbach Patent Law Group, LLC

(57) ABSTRACT

A tandem TOF mass spectrometer includes a first TOF mass analyzer that generates an ion beam comprising a plurality of ions and that selects a group of precursor ions from the plurality of ions. A pulsed ion accelerator accelerates and refocuses the selected group of precursor ions. An ion fragmentation chamber is positioned to receive the selected group of precursor ions that is refocused by the pulsed ion accelerator. At least some of the selected group of precursor ions is fragmented in the ion fragmentation chamber. A second TOF mass analyzer receives the selected group of precursor ions and ion fragments thereof from the ion fragmentation chamber and separates the ion fragments and then detects a fragment ion mass spectrum.

28 Claims, 12 Drawing Sheets

(56) References Cited

U.S. PATENT DOCUMENTS

| | | | | |
|---|---|---|---|---|
| 5,144,127 | A | 9/1992 | Williams et al. | |
| 5,160,840 | A | 11/1992 | Vestal | |
| 5,166,518 | A | 11/1992 | Freedman | |
| 5,510,613 | A * | 4/1996 | Reilly et al. | 250/287 |
| 5,625,184 | A | 4/1997 | Vestal et al. | |
| 5,627,369 | A | 5/1997 | Vestal et al. | |
| 5,847,385 | A | 12/1998 | Dresch | |
| 5,861,623 | A * | 1/1999 | Park | 250/287 |
| 6,057,543 | A | 5/2000 | Vestal et al. | |
| 6,300,627 | B1 | 10/2001 | Koster et al. | |
| 6,489,610 | B1 * | 12/2002 | Barofsky et al. | 250/287 |
| 6,512,225 | B2 | 1/2003 | Vestal et al. | |
| 6,534,764 | B1 | 3/2003 | Verentchikov et al. | |
| 6,621,074 | B1 | 9/2003 | Vestal | |
| 6,661,001 | B2 * | 12/2003 | Park | 250/287 |
| 6,872,941 | B1 | 3/2005 | Whitehouse et al. | |
| 7,214,320 | B1 | 5/2007 | Gregori et al. | |
| 7,223,966 | B2 | 5/2007 | Weiss et al. | |
| 7,355,169 | B2 | 4/2008 | McLuckey et al. | |
| 7,498,588 | B1 | 3/2009 | Gordon et al. | |
| 7,564,026 | B2 | 7/2009 | Vestal | |
| 7,564,028 | B2 | 7/2009 | Vestal | |
| 7,589,319 | B2 | 9/2009 | Vestal | |
| 7,663,100 | B2 | 2/2010 | Vestal | |
| 7,667,195 | B2 | 2/2010 | Vestal | |
| 7,932,491 | B2 | 4/2011 | Vestal | |
| 2002/0158194 | A1 | 10/2002 | Vestal et al. | |
| 2003/0141447 | A1 | 7/2003 | Verentchikov et al. | |
| 2003/0180807 | A1 | 9/2003 | Hess et al. | |
| 2004/0119012 | A1 | 6/2004 | Vestal | |
| 2004/0203175 | A1 | 10/2004 | Li et al. | |
| 2004/0213721 | A1 | 10/2004 | Arno et al. | |
| 2005/0035285 | A1 | 2/2005 | Tan et al. | |
| 2005/0116162 | A1 | 6/2005 | Vestal | |
| 2005/0242279 | A1 | 11/2005 | Verentchikov | |
| 2005/0269505 | A1 | 12/2005 | Ermer | |
| 2005/0279933 | A1 | 12/2005 | Appelhans et al. | |
| 2006/0266941 | A1 | 11/2006 | Vestal | |
| 2008/0067349 | A1 | 3/2008 | Moskovets et al. | |
| 2008/0078931 | A1 | 4/2008 | Vestal et al. | |
| 2008/0272291 | A1 | 11/2008 | Vestal | |
| 2009/0294658 | A1 | 12/2009 | Vestal et al. | |
| 2010/0181473 | A1 | 7/2010 | Blenkinsopp et al. | |
| 2010/0276585 | A1 | 11/2010 | Lehmann | |
| 2010/0301202 | A1 | 12/2010 | Vestal | |
| 2011/0049350 | A1 | 3/2011 | Vestal | |
| 2011/0155901 | A1 | 6/2011 | Vestal | |
| 2011/0266431 | A1 | 11/2011 | Vestal | |

FOREIGN PATENT DOCUMENTS

| | | | |
|---|---|---|---|
| WO | 2006-064280 | A2 | 6/2006 |
| WO | 2006/064280 | A2 | 6/2006 |
| WO | 2010-138781 | A2 | 12/2010 |

OTHER PUBLICATIONS

"Notification of Transmittal of the International Search Report and the Written Opinion of the International Searching Authority, or the Declaration" for PCT/US2012/025761, Sep. 25, 2012, 9 pages, International Searching Authority/KR, Daejeon Metropolitan City, Republic of Korea.

"Notification Concerning Transmittal of International Preliminary Report on Patentability (Chapter I of the Patent Cooperation Treaty" for PCT/US2010/060902, Jul. 12, 2012, 7 pages, The International Bureau of WIPO, Geneva, Switzerland.

Beavis, Ronald C., et al., Factors Affecting the Ultraviolet Laser Desorption of Properties, Rapid Communications in Mass Spectrometry, 1989, pp. 233-237, vol. 3 No. 9, Heyden & Son Limited.

Bergmann, T., et al., High-Resolution Time-of-Flight Mass Spectrometer, Rev. Sci. Instrum., Apr. 1989, pp. 792-793, vol. 60, No. 4, American Institute of Physics.

Beussman, Douglas J., et al., Tandem Reflectron Time-of-Flight Mass Spectrometer Utilizing Photodissociation, Analytical Chemistry, Nov. 1, 1995, pp. 3952-3957, vol. 67, No. 21, American Chemical Society.

Colby, Steven M., et al., Space-Velocity Correlation Focusing, Analytical Chemistry, Apr. 15, 1996, pp. 1419-1428, vol. 68, No. 8, American Chemical Society.

Cornish, Timothy J., et al., A Curved Field Reflectron Time-of-Flight Mass Spectrometer for the Simultaneous Focusing of Metastable Product Ions, Rapid Communication in Mass Spectrometry, 1994 pp. 781-785, vol. 8, John Wiley & Sons.

Cornish, Timothy J., et al., Tandem Time-of-Flight Mass Spectrometer, Analytical Chemistry, Apr. 15, 1993, pp. 1043-1047, vol. 65, No. 8.

Hillenkamp, F., Laser Desorption Mass Spectrometry: Mechanisms, Techniques and Applications, 1989, pp. 354-362, vol. 11A, Heyden & Son, London.

Kaufmann, R., et al., Mass Spectrometric Sequencing of Linear Peptides by Product-Ion Analysis in a Reflectron Time-of-Flight Mass Spectrometer Using Matrix Assisted Laser Desorption Ionization, Rapid Communications in Mass Spectrometry, 1993, pp. 902-910, vol. 7, John Wiley & Sons, Ltd.

Mamyrin, B.A. et al., The Mass-Reflectron, A New Nonmagnetic Time-of-Flight Mass Spectrometer With High Resolution, Sov. Phys. 1973, pp. 45-48, vol. 37, No. 1, American Institute of Physics.

Matsuda, H., et al., Particle Flight Times Through Electrostatic and Magnetic Sector Fields and Quadrupoles to Second Order, International Journal of Mass Spectrometry and Ion Physics, 1982, pp. 157-168, vol. 42, Elsevier Scientific Publishing Company, Amsterdam, The Netherlands.

Neuser, H. J., et al., High-Resolution Laser Mass Spectrometry, International Journal of Mass Spectrometry and Ion Process, 1984, pp. 147-156, vol. 60, Elsevier Science Publishers B.V., Amsterdam, The Netherlands.

Vestal, M. L., et al., Delayed Extraction Matrix-Assisted Laser Desorption Time-of-Flight Mass Spectrometry, Rapid Communications in Mass Spectrometry, 1995, pp. 1044-1050, vol. 9, John Wiley & Sons, Ltd.

Vestal, M. L., et al., Resolution and Mass Accuracy in Matrix Accuracy in Matrix-Assisted Laser Desorption Ionization-Time-of-Flight, American Society for Mass Spectrometry, 1998, pp. 892-911, Elsevier Science, Inc.

Vestal, M., High Performance MALDI-TOF Mass Spectrometry for Proteomics, International Journal of Mass Spectrometry, 2007, pp. 83-92.

Wiley, W. C., et al., Time-of-Flight Mass Spectrometer With Improved Resolution, The Review of Scientific Instruments, Dec. 1955, pp. 1150-1157, vol. 26, No. 13.

Zhou, J. Kinetic Energy Measurements of Molecular Ions Ejected Into an Electric Field by Matrix-Assisted Laser Desorption, Rapid Communications in Mass Spectrometry, Sep. 1992, pp. 671-678, vol. 6, John Wiley & Sons, Ltd.

Vestal, M., Linear Time-of-Flight Mass Spectrometry With Simultaneous Space and Velocity Focusing, U.S. Appl. No. 12/968,254, filed Dec. 14, 2010.

"Notification of Transmittal of the International Search Report and the Written Opinion of the International Searching Authority, or the Declaration" for PCT/US2010/022122, Aug. 16, 2010, 9 pages, International Searching Authority, Korean Intellectual Property Office, Seo-gu, Daejeon, Republic of Korea.

"Notification Concerning Transmittal of International Preliminary Report on Patentability (Chapter I of the Patent Cooperation Treaty)" for PCT/US2009/045108, Dec. 9, 2010, 9 pages, The International Bureau of WIPO, Geneva, Switzerland.

"Notification of Transmittal of the International Search Report and the Written Opinion of the International Searching Authority, or the Declaration" for PCT/US2010/046074, Apr. 15, 2011, 8 pages, International Searching Authority, Korean Intellectual Property Office, Seo-gu, Daejeon, Republic of Korea.

"Notification of Transmittal of the International Search Report and the Written Opinion of the International Searching Authority, or the Declaration" for PCT/US2010/036501, Jan. 4, 2011, 9 pages, Inter-

(56) References Cited

OTHER PUBLICATIONS national Searching Authority, Korean Intellectual Property Office, Seo-gu, Daejeon, Republic of Korea.

"Notification Concerning Transmittal of International Preliminary Report on Patentability (Chapter I of the Patent Cooperation Treaty" for PCT/US2010/046074, Mar. 8, 2012, 5 pages, The International Bureau of WIPO, Geneva, Switzerland.

"Office Action" for U.S. Appl. No. 12/651,070, Dec. 9, 2011, 31 pages.

"Office Action" for U.S. Appl. No. 12/651,070, May 24, 2011, 50 pages.

"Office Action" for U.S. Appl. No. 12/968,254, May 14, 2012, 23 pages.

"Notification Concerning Transmittal Of International Preliminary Report On Patentability" for PCT/US2012/025761, Sep. 6, 2013, 6 pages, The International Bureau of WIPO, Geneva, Switzerland.

"Notification Of Transmittal Of The International Search Report And The Written Opinion Of The International Searching Authority, Or The Declaration" for PCT/US2013/028953, Jun. 27, 2013, 13 pages, Korean Intellectual Property Office, Daejeon Metropolitan City, Republic of Korea.

"Notification Concerning Transmittal Of International Preliminary Report On Patentability" for PCT/US2011/063855, Jun. 27, 2013, 8 pages, The International Bureau of WIPO, Geneva, Switzerland.

* cited by examiner

TANDEM TIME-OF-FLIGHT MASS SPECTROMETRY WITH SIMULTANEOUS SPACE AND VELOCITY FOCUSING

CROSS-REFERENCE TO RELATED APPLICATIONS

The present application is a continuation-in-part of U.S. patent application Ser. No. 12/549,076, filed on Aug. 27, 2009. The present application is also a continuation-in-part of U.S. patent application Ser. No. 12/968,254, filed on Dec. 14, 2010. The present application is also a continuation-in-part of U.S. patent application Ser. No. 13/034,525, filed on Feb. 24, 2011, which is a continuation-in-part of U.S. patent application Ser. No. 12/968,254, filed on Dec. 14, 2010. The entire contents of U.S. patent application Ser. Nos. 12/549,076, 12/968,254, and 13/034,525 are all herein incorporated by reference.

The section headings used herein are for organizational purposes only and should not be construed as limiting the subject matter described in the present application in any way.

INTRODUCTION

Many mass spectrometer applications require an accurate determination of the molecular masses and relative intensities of metabolites, peptides, and intact proteins in complex mixtures. Tandem mass spectrometry provides information on the structure and sequence of many biological polymers and allows unknown samples to be accurately identified. Tandem mass spectrometers employ a first mass analyzer to produce, separate and select a precursor ion, and a second mass analyzer to fragment the selected ions and record the fragment mass spectrum from the selected precursor. A wide variety of mass analyzers and combinations thereof for use in tandem mass spectrometry are known in the literature.

An important advantage of TOF Mass Spectrometry (MS) is that essentially all of the ions produced are detected, which is unlike scanning MS instruments. This advantage is lost in conventional MS-MS instruments where each precursor is selected sequentially and all non-selected ions are lost. This limitation can be overcome by selecting multiple precursors following each laser shot and recording fragment spectra from each can partially overcome this loss and dramatically improve speed and sample utilization without requiring the acquisition of raw spectra at a higher rate.

Several approaches to matrix assisted laser desorption/ionization (MALDI)-TOF MS-MS are described in the prior art. All of these approaches are based on the observation that at least a portion of the ions produced in the MALDI ion source may fragment as they travel through a field-free region. Ions may be energized and fragment as the result of excess energy acquired during the initial laser desorption process, or by energetic collisions with neutral molecules in the plume produced by the laser, or by collisions with neutral gas molecules in the field-free drift region. These fragment ions travel through the drift region with approximately the same velocity as the precursor, but their kinetic energy is reduced in proportion to the mass of the neutral fragment that is lost. A timed ion selector may be placed in the drift space to transmit a small range of selected ions and to reject all others. In a TOF mass analyzer employing a reflector, the lower energy fragment ions penetrate less deeply into the reflector and arrive at the detector earlier in time than the corresponding precursors. Conventional reflectors focus ions in time over a relatively narrow range of kinetic energies. Thus, only a small mass range of fragments are focused for given potentials applied to the reflector.

In work by Spengler and Kaufmann, the limitation in mass range was overcome by taking a series of spectra at different mirror voltages and piecing them together to produce the complete fragment spectrum. An alternate approach is to use a "curved field reflector" that focuses the ions in time over a broader energy range. The TOF-TOF approach employs a pulsed accelerator to re-accelerate a selected range of precursor ions and their fragments so that the energy spread of the fragments is sufficiently small that the complete spectrum can be adequately focused using a single set of reflector potentials. All of these approaches have been used to successfully produce MS-MS spectra following MALDI ionization, but each suffers from serious limitations that have stalled widespread acceptance. For example, each approach involves relatively low-resolution selection of a single precursor, and generation of the MS-MS spectrum for that precursor, while ions generated from other precursors present in the sample are discarded. Furthermore, the sensitivity, speed, resolution, and mass accuracy for the first two techniques are inadequate for many applications.

The first practical time-of-flight (TOF) mass spectrometer was described by Wiley and McClaren more than 50 years ago. TOF mass spectrometers were generally considered to be only a tool for exotic studies of ion properties for many years. See, for example, "Time-of-Flight Mass Spectrometry: Instrumentation and Applications in Biological Research," Cotter R J., American Chemical Society, Washington, D.C. 1997, for review of the history, development, and applications of TOF-MS in biological research.

Early TOF mass spectrometer systems included ion sources with electron ionization in the gas phase where a beam of electrons is directed into the ion source. The ions produced have a distribution of initial positions and velocities that is determined by the intersection of the electron beam with the neutral molecules present in the ion source. The initial position of the ions and their velocities are independent variables that affect the flight time of the ions in a TOF-MS. Wiley and McLaren developed and demonstrated methods for minimizing the contribution of each of these distributions. Techniques for minimizing the contribution of initial position are called "space focusing" techniques. Techniques for minimizing the contribution of initial velocity are called "time lag focusing" techniques. One important conclusion made by Wiley and McLaren is that it is impossible to simultaneously achieve both space focusing and velocity focusing. According to Wiley and McLaren, optimization of these TOF mass spectrometers requires finding the optimum compromise between the space focusing and velocity focusing distributions.

The advent of naturally pulsed ion sources such as CF plasma desorption ions source, static secondary ion mass spectrometry (SIMS), and matrix-assisted laser desorption/ionization (MALDI) ion sources has led to renewed interest in TOF mass spectrometers. Recent work in TOF mass spectrometry has focused on developing new and improved TOF instruments and software that take advantage of MALDI and electrospray (ESI) ionization sources that have removed the volatility barrier for mass spectrometry and that have facilitated applications of important biological applications.

The ion focusing techniques used with MALDI and electrospray (ESI) ion sources reflect the practical limits on the position and velocity distributions that can be achieved with these techniques. Achieving optimum performance with electrospray ionization and MALDI ionization methods requires finding the best compromise between space and velocity focusing. Electrospray ionization methods have been developed to improve space focusing. Electrospray ionization forms a beam of ions with a relatively broad distribution of initial positions and a very narrow distribution in velocity in the direction that ions are accelerated.

In contrast, MALDI ionization methods have been developed to improve velocity focusing. MALDI ionization methods use samples deposited in matrix crystals on a solid surface. The variation in the initial ion position is approximately equal to the size of the crystals, which is small. However, the velocity distribution is relatively broad because the ions are energetically ejected from the surface by the incident laser irradiation.

Known TOF mass spectrometers use delayed pulsed acceleration in the ion source to achieve first order velocity focusing for a single selected ion mass-to-charge ratio. Delayed pulsed acceleration was referred to as "time lag focusing" by Wiley and McLaren and more recently is referred to as "delayed extraction" or "delayed pulsed extraction." Although time lag focusing provides first order velocity focusing for a selected mass, it is not suitable for focusing a broad range of masses as described above. Furthermore, time lag focusing does not correct for variations in the initial ion position.

BRIEF DESCRIPTION OF THE DRAWINGS

The present teachings, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teachings in any way.

DEFINITIONS

Figure 1:
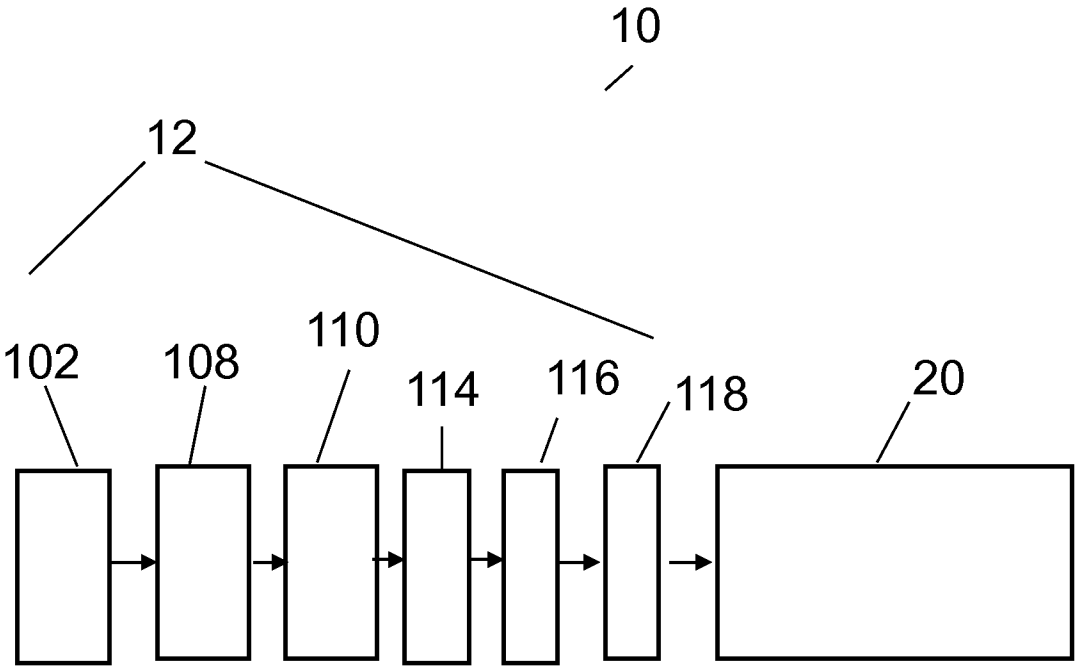
FIG. 1 illustrates a block diagram of a tandem time-of-flight mass spectrometer according to the present teaching.

The following variables are used in the Description of Various Embodiments section:

$D$=Distance in a field-free region;
$D_v$=Distance to the first order velocity focus point;
$D_s$=Distance to the first order spatial focus point;
$D_e$=Effective length of an equivalent field-free region;
$D_{es}$=Effective length of a two-field accelerating field;
$D_a$=Distance from the end of the static field to the center of the pulsed accelerating field;
$d_a$=Length of the first accelerating field;
$d_b$=Length of the second accelerating field;
$d_1$=Length of the pulsed acceleration region;
$\delta x$=Spread in initial position of the ions;
$\Delta t$=Time lag between the ion production and the application of the accelerating field;
$p$=Total effective perturbation accounting for all of the initial conditions;
$p_1$=Perturbation due to initial velocity distribution;
$p_2$=Perturbation due to initial spatial distribution;
$V$=Total acceleration potential;
$V_g$=Voltage applied to the extraction electrode;
$v_n$=Nominal final velocity of the ion after acceleration;
$V_p$=Amplitude of the pulsed voltage;
$y$=Ratio of the total accelerating potential V to the accelerating potential difference in the first field;
$m_0$=Mass of the ion focused to first order at the detector; and
$\delta t$=Width of the peak at the detector.

DESCRIPTION OF VARIOUS EMBODIMENTS

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously as long as the teaching remains operable. Furthermore, it should be understood that the apparatus and methods of the present teachings can include any number or all of the described embodiments as long as the teaching remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

The present teaching relates to tandem time-of-flight mass spectrometer apparatus and methods of operating tandem time-of-flight mass spectrometer apparatus that employ a first stage time-of-flight analyzer which provides simultaneous space and velocity focusing for an ion of predetermined mass-to-charge ratio. In addition, the present teaching relates to tandem time-of-flight mass spectrometer apparatus and methods of operating tandem time-of-flight mass spectrometer apparatus that provide high mass resolution performance for a broad range of ions.

One aspect of the present teaching is that it has been discovered that pulsed acceleration in the ion source is not required to achieve velocity focusing. Another aspect of the present teaching is that it has been discovered that pulsed acceleration can be used for initiating time-of-flight measurements when a continuous beam of ions is generated. Another aspect of the present teaching is that it has been discovered that higher mass resolution can be achieved by using pulsed acceleration for initiating TOF measurements. Yet another aspect of the present teaching is that it has been discovered that using a first stage time-of-flight mass analyzer with simultaneous space and velocity focusing allows high resolution precursor selection to be achieved and also reduces the velocity spread of selected ions, thereby allowing high resolution fragment spectra to be generated and recorded in a second stage time-of-flight mass analyzer. These and other aspects of the present teaching are described in more detail below.

FIG. 1 shows a block diagram of a tandem time-of-flight mass spectrometer 10 according to the present teaching. The tandem time-of-flight mass spectrometer 10 performs the following functions; (1) separating precursor ions according to their mass-to-charge ratio; (2) selecting a predetermined set of precursor ions; (3) fragmenting the selected precursor ions, (4) separating fragment ions from each selected precursor ion according to the mass-to-charge ratio of the fragments, and (5) detecting and recording the mass spectra of the fragment ions.

The first time-of-flight mass analyzer 12 comprises an ion source 102 that generates a pulse of ions, a pulsed ion accelerator 108, a low resolution timed ion selector 110, a first field-free drift space 114, a high resolution timed ion selector 116, and a second field-free drift space 118. The ion source 102 generates a pulse of ions. The pulsed ion accelerator 108 accelerates the pulse of ions. The low resolution timed ion selector 110 transmits a range of masses accelerated in pulsed accelerator 108 and rejects all others. The high resolution timed ion selector 116 transmits a predetermined set of precursor ions accelerated by pulsed ion accelerator 108. Selected precursor ions and fragments thereof produced in either field-free drift space 114 or 118 are transmitted to the second stage time-of-flight analyzer 20 where fragment ions from each selected precursor are separated according to the mass-to-charge ratio of the fragment and detected and recorded to produce mass spectra of the fragment ions.

The first time-of-flight analyzer 12 provides simultaneous space and velocity focusing for an ion of predetermined mass-to-charge ratio at the timed ion selector 116. In addition, the first time-of-flight analyzer 12 minimizes the focusing error for ions within a predetermined mass range including the focused mass.

In some embodiments, field-free drift spaces 114 and 118 comprise fragmentation chambers wherein ions may fragment spontaneously as the result of internal excitation in the ion source or as the result of excitation by collisions with neutral molecules in field-free spaces 114 or 118. In some embodiments, the pressure in at least one of the field-free regions 114 or 118 is increased to enhance excitation by collisions with neutral molecules. In some embodiments, at least one of the field-free regions 114 or 118 may be enclosed and differential pumped employed to allow the pressure in these regions to be increased without increasing the pressure in other regions of the tandem mass spectrometer. In general, in various embodiments, the pressure in each of the regions of the first time-of-flight analyzer 12 can be optimized separately.

Figure 2:
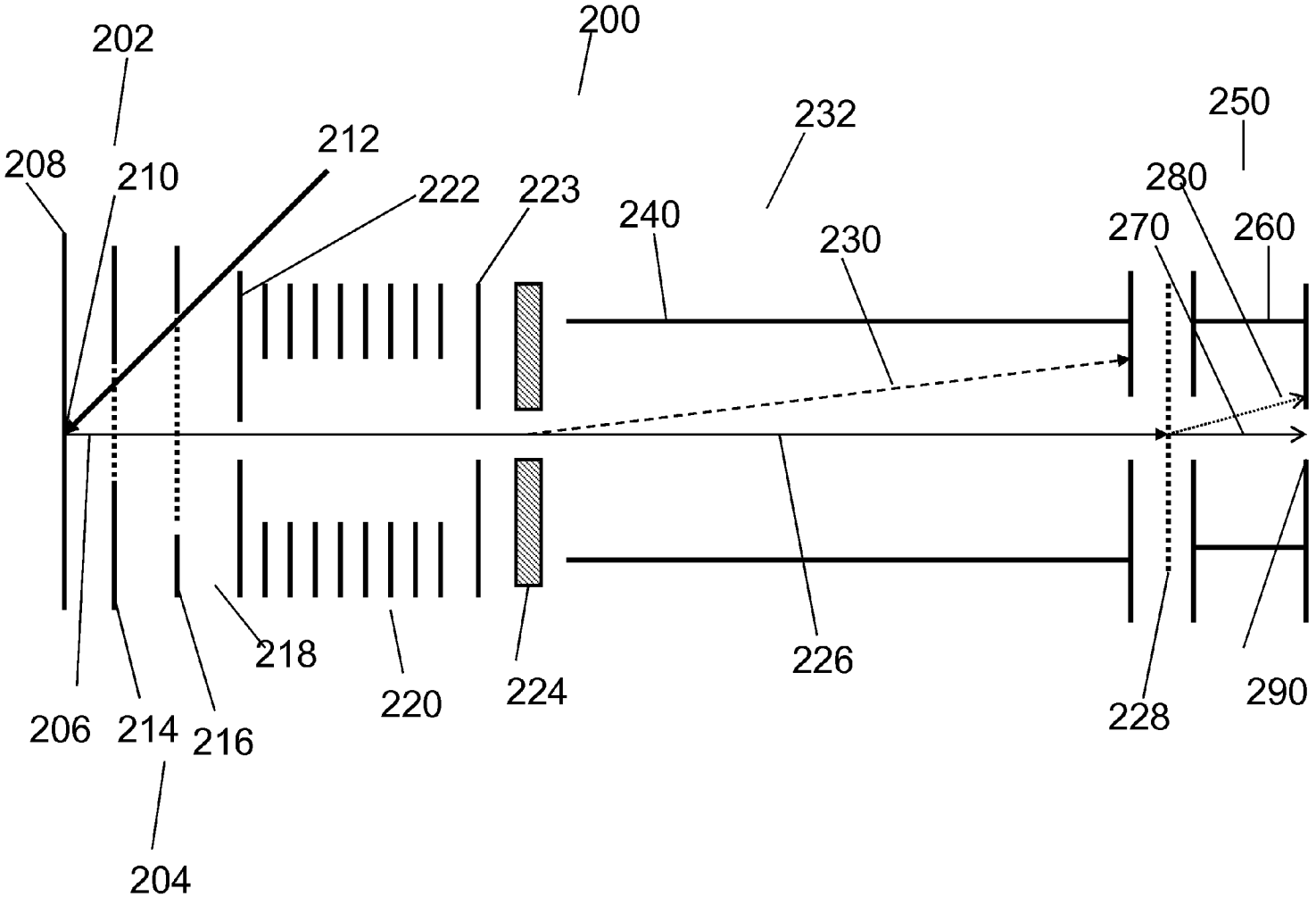
FIG. 2 shows a schematic diagram of a first stage of the tandem time-of-flight mass spectrometer according to the present teaching that provides simultaneous space and velocity focusing.

FIG. 2 shows a schematic diagram of a first stage 200 of the tandem time-of-flight mass spectrometer according to the present teaching that provides simultaneous space and velocity focusing. The first stage 200 time-of-flight mass spectrometer comprises a pulsed ion source 202 that generates a pulse of ions, a pulsed ion accelerator 220, a low resolution timed ion selector 224, a first field-free drift space 232, a high resolution timed ion selector 228 and a second field-free drift space 250. The low resolution timed ion selector 224 transmits a range of ion masses accelerated in pulsed accelerator 220 and rejects all others ions masses. Rejected ions are deflected along ion path 230 and selected ions travel along ion path 226 to high resolution timed ion selector 228. The high resolution time-ion-selector 228 transmits a predetermined set of precursor ions 270 accelerated by pulsed ion accelerator 220 through second field-free drift space 250 to the entrance aperture 290 of the second time-of-flight mass spectrometer 20 (FIG. 1). Rejected ions are deflected along ion path 280 and selected ions travel along ion path 270.

The ion source 202 generates a pulse of ions 206. In one embodiment the ion source 202 includes a sample plate 208 that positions a sample 210 for analysis. An energy source, such as a laser, is positioned to provide a beam of energy 212 to the sample 210 positioned on the sample plate 208 that ionizes sample material and generates a pulse of ions 206. The beam of energy 212 can be a pulsed beam of energy, such as a pulsed beam of light. In another embodiment, a continuous source of ions is transmitted to ion source 202 and an accelerating pulse is applied periodically to ion source 202 to produce a pulse of ions.

The pulse of ions 206 is accelerated by ion accelerator 204 that includes a first 214 and second electrode 216 positioned adjacent to the sample plate 208. A pulsed ion accelerator 220 is positioned adjacent to the second electrode 216. In some embodiments, a first field-free ion drift space 218 is positioned between the electrode 216 and the pulsed ion accelerator 220. The pulsed ion accelerator 220 includes an entrance plate 222. A timed ion selector 224 is positioned adjacent to the pulsed ion accelerator 220. A field-free ion drift space 232 is positioned adjacent to the timed ion selector 224. A high resolution timed ion selector 228 is positioned at the end of the field-free ion drift space 232.

In operation, a beam of energy 212, which can be a pulsed beam of energy or a continuous beam is generated and directed to sample 210. Sample 210 may be deposited on the surface of sample plate 208 or may be present in the gas phase adjacent to sample plate 208. The pulsed beam of energy 212 can be a pulsed laser beam that produces ions from samples present either on sample plate 208 or in the gas phase proximate to the sample plate 208. A pulse of ions can also be produced by either a pulsed or continuous beam of ions to produce ions from samples present either on sample plate 208 or in the gas phase proximate to the sample plate 208 by a method known as secondary ionization mass spectrometry (SIMS). In some methods of operation, the sample 210 includes a UV absorbing matrix and ions are produced by matrix assisted laser desorption ionization (MALDI). In another method of operation, a continuous source of ions is produced by electrospray ionization and transmitted to ion source 202 and an accelerating pulse is applied periodically to ion source 202 to produce a pulse of ions.

The ion accelerator 204 is biased with a voltage to accelerate the pulse of ions into the pulsed ion accelerator 220. The pulsed ion accelerator 220 accelerates the pulse of ions. The timed ion selector 224 transmits ions accelerated by the pulsed ion accelerator 220 into the field-free drift space 226 and rejects other ions by directing the ions along trajectory 230. The accelerated ions transmitted by the timed ion selector 224 are then transmitted to high resolution timed ion selector 228.

Figure 3:
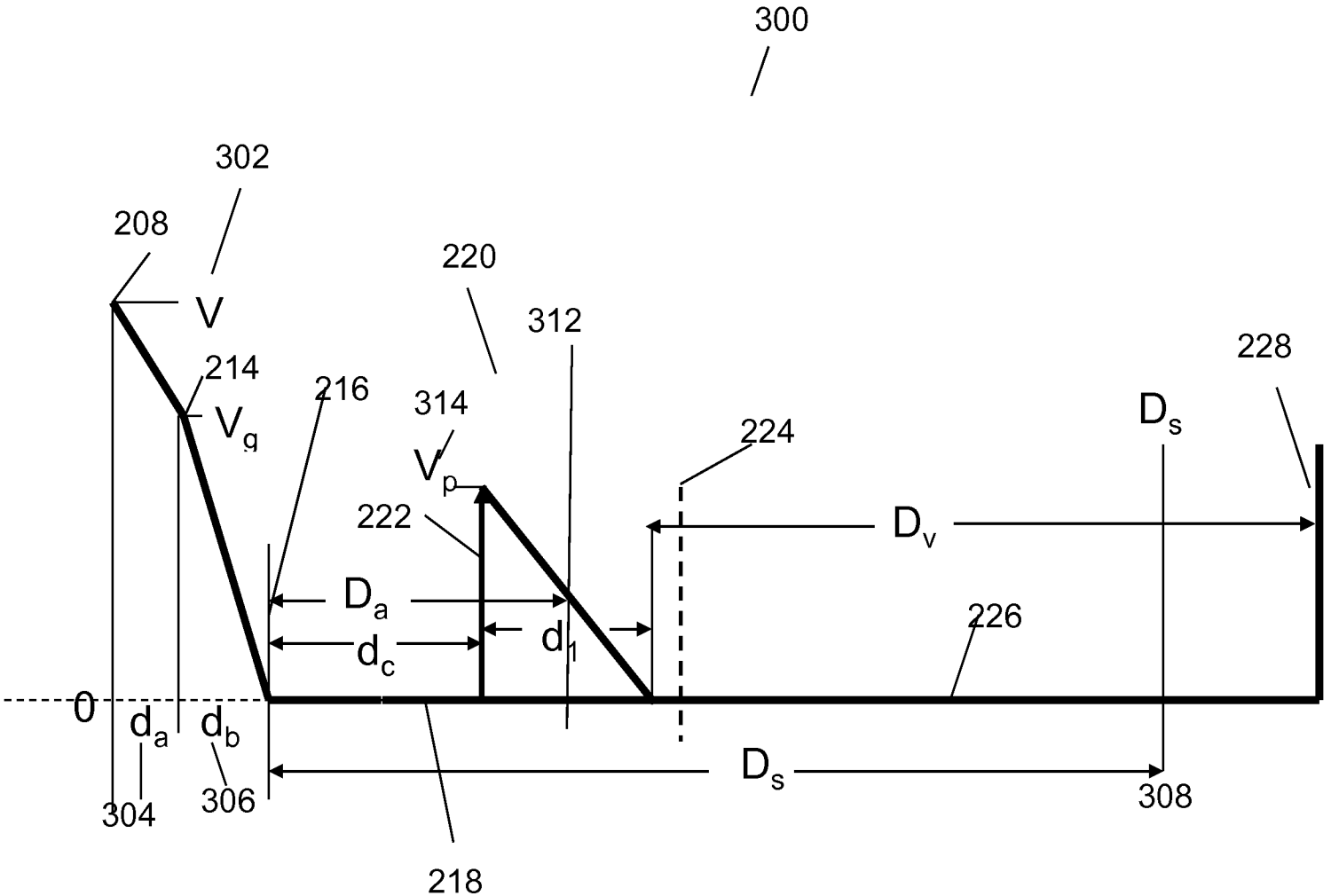
FIG. 3 is a potential diagram for a first stage of the tandem time-of-flight mass spectrometer according to the present teaching that was described in connection with FIG. 2.

FIG. 3 is a potential diagram 300 of a first time-of-flight mass spectrometer 200 according to the present teaching that was described in connection with FIG. 2. Referring to both the first TOF mass spectrometer 200 shown in FIG. 2 and to the potential diagram 300 shown in FIG. 3, the potential diagram 300 includes a two-field ion acceleration region 302. In one embodiment, a static voltage V is applied to the sample plate 208. In another embodiment a pulsed voltage V is applied to sample plate 208. A static voltage $V_g$ is applied to the first electrode 214 which is positioned a distance $d_a$ 304 away from the sample plate 208. The second electrode 216, which is positioned a distance $d_b$ 306 away from the first electrode 214, is at ground potential. The voltages V and $V_g$ applied to the sample plate 208 and to the first electrode 214 focus the ions generated on or near sample plate 208 at a point $D_s$ 308 in field-free drift space 226. At distance $D_s$ 308, the flight time of any mass is independent (to first order) on the initial position of the ions produced on or near ion sample plate 208.

The entrance plate 222 of the pulsed ion accelerator 220 is positioned adjacent to the second electrode 216. In some embodiments, the entrance plate 222 of the pulsed ion accelerator 220 is at a distance $d_c$ from the second electrode 216, which is at grounded potential. When an ion of predetermined mass-to-charge ratio reaches a predetermined point 312 in the pulsed accelerator 220, a pulsed voltage $V_p$ 314 is applied to the entrance plate 222 of the pulsed ion accelerator 220. The pulsed voltage $V_p$ focuses the ions through the second field-free drift space 226 to the high resolution timed ion selector 228, thereby removing (to first order) the effect of both initial position and initial velocity of the ions on the flight time from the pulsed accelerator 220 to the high resolution timed ion selector 228. The low resolution timed ion selector 224 located adjacent to the exit 223 of the pulsed accelerator 220 is activated to transmit only ions accelerated by the pulsed accelerator 220 and to also prevent all other ions from reaching the high resolution selector 228.

To illustrate this aspect of the present teaching, an analysis of a two-field ion accelerator for a first time-of-flight mass spectrometer is presented to show that both spatial and velocity focusing can be achieved simultaneously. The space focusing distance for a two-field ion accelerator is given by $$D_s=2d_a y^{3/2}[1-(d_b/d_a)/(y+y^{1/2})]$$

where $d_a$ is the length of the first accelerating field, $d_b$ is the length of the second accelerating field and y is the ratio of the total accelerating potential V to the accelerating potential in the first field $V-V_g$, and where $V_g$ is the potential applied the electrode intermediate to the two fields. The total effective length of the source is given by $$D_{es}=2d_a y^{1/2}[1+(d_a/d_b)/(y^{1/2}+1)].$$

Thus, the time for ions to travel to point $D_v$ from the exit 223 of the pulsed accelerator 220 is independent of the perturbation in velocity if $$D_v=2d_1(V_a+V)/V_p$$

where $V_p$ is the amplitude of the pulsed voltage, $V_a$ is the acceleration given to a predetermined precursor mass, and $d_1$ is the length of the pulsed accelerating field. If the predetermined mass is at the center of the pulsed accelerating field, then it follows that $$(V_a/V)=q_0=V_p/2V \text{ and}$$

$$D_v=2d_1(1+q_0)/2q_0.$$

The spatial focusing error also contributes to an increase in the mass-to-charge ratio peak width. The kinetic energy of ions with the spatial focusing error is given by $zV(1-p_2)$, where the perturbation in spatial focusing is given by $$p_2=(\delta x/2d_a y).$$

At the space focus point, the ions with higher energy overtake the ions with lower energy. If the space focus is located at a greater distance than the pulsed accelerator, for example, in the vicinity of the detector, then the lower energy ions arrive at the pulsed accelerator before those with higher energy. The later arriving ions with relatively high energy are accelerated by the pulsed ion accelerator more than the ions with relatively low energy, which effectively increases their space focal distance. Thus, the change in spatial focal point due to the pulsed accelerator to first order is approximately $$\Delta D/D_v=(q_0/2).$$

It has been discovered that the space focus and velocity focus can be made to coincide by adjusting the value of y so that $$D_s=D_v-\Delta D=D_v(1-q_0/2).$$

The focus position as a function of mass can be expressed as $$(D_v/2d)=(1+q)(V/V_p)$$

where $q=q_o[1+2(D_{ea}/d_1)(1-(m_0/m)^{1/2}\}]$ and $m_0$ is the mass of the ion focused to first order at the high resolution timed ion selector 228. $D_{ea}=D_{es}+D_a$, where $D_{es}$ is the effective length of the first accelerating field and $D_a$ is the distance from the end of the first field to the center of the pulsed accelerating field. The relative focusing error as function of mass is then equal to $$\Delta D/D_v=(q-q_0)/(1+q_0).$$

The maximum mass accelerated in the pulsed accelerator 220 under these conditions corresponds to $q=2q_0$, and the minimum mass accelerated in the pulsed accelerator 220 under these conditions corresponds to q=0. Thus, the mass range that can be accelerated and focused is given by $$m_{max}/m_{min}=[(1+d_1/2D_{ea})/(1-d_1/2D_{ea})]^2.$$

The width of the peak at the selector 228 relative to the flight time is then given to first order by $$\delta t/t=p\Delta D/D=p(q-q_0)/(1+q_0).$$

Since $p_1$ and $p_2$ are independent variables, the total effective perturbation accounting for all of the initial conditions is given by $$p=[p_1^2+p_2^2]^{1/2} \text{ where}$$

$$p_1=[q_0/(1+q_0)][d_a y/d_1](\delta v_0/v_n) \text{ and}$$

$$p_2=[(1+q_0)^{-1}](\delta x/2d_a y).$$

In general, the contribution to peak width is dominated by the velocity spread. In this case, the peak width of a mass in the range of accelerated masses is given by $$\delta m/m=4(D_{ea}d_a y/D_v^2)[1-(m_0/m)^{1/2}](\delta v_0/v_n).$$

Thus, precursor ions covering the full range of ions accelerated by pulsed accelerator 220 can be selected with high resolving power. Furthermore, the velocity spread of selected ions is given by $p_1$ and is reduced relative to the velocity spread from the ions source.

Referring to both FIGS. 2 and 3, the first time-of-flight mass spectrometer 200 according to the present teaching comprises a pulsed ion source 202 generating a pulse of ions 206. The pulse of ions 206 can be generated as illustrated in FIG. 2 by employing a pulsed source of energy and a static accelerating field. Alternatively, in another embodiment, the pulse of ions can be generated by a continuous source of ions combined with pulsing or modulating the potential applied to either electrode. Numerous types of ions sources can be used. For example, the continuous ion source can be an external ion source wherein the beam of ions is injected orthogonal to the axis of the ion flight path. In some embodiments, the external ion source is an electrospray ion source. In other embodiments, the continuous ion source is an electron beam that produces ions from molecules in the gas phase.

In one embodiment, a first fragmentation chamber 240 is positioned in first field-free drift space 232. Ions accelerated by the first pulsed accelerator 220 and selected by the low resolution timed ion selector 224 enter into fragmentation chamber 240 where some of the precursor ions are fragmented. Ions exiting from fragmentation chamber 240 are separated with higher resolution by the high resolution timed ion selector 228. In some embodiments, ions transmitted by the ion selector 228 are fragmented further in the fragmentation chamber 260 positioned in the field-free space 250. Selected ions and fragment thereof are transmitted through entrance aperture 290 for the second time-of-flight mass spectrometer 20 (FIG. 1) that separates fragment ions from precursors and that allows fragment ion masses to be accurately determined from time-of-flight spectra.

A high resolution timed ion selector 228 is positioned at the simultaneous velocity and space focus of first time-of-flight mass spectrometer 200. In one embodiment, the timed ion selector 228 is a Bradbury-Nielsen type ion shutter or gate. A Bradbury-Nielsen type ion shutter or gate is an electrically activated ion gate. Bradbury-Nielsen timed ion selectors include parallel wires that are positioned orthogonal to the path of the ion beam. High-frequency voltage waveforms of opposite polarity are applied to alternate wires in the gate. The gates only pass charged particles at certain times in the waveform cycle when the voltage difference between wires is near zero. At other times, the ion beam is deflected to some angle by the potential difference established between the neighboring wires. The wires are oriented so that ions rejected by the timed ion selector 228 are deflected away from the entrance aperture 290 for the second time-of-flight mass spectrometer 20 (FIG. 1).

A first ion fragmentation chamber 240 is positioned in the field-free space 232 between the output of the low resolution timed ion selector 224 and the high resolution timed ion selector 228. A second fragmentation chamber 260 is positioned between the output from high resolution timed ion selector 228 and the entrance aperture 290 to second time-of-flight mass spectrometer 20 (FIG. 1). One skilled in the art will appreciate that any type of fragmentation chamber can be used. In one embodiment, at least one of fragmentation chamber 240 and 260 is a collision cell containing a collision gas and an RF-excited octopole that guides fragment ions. The ion fragmentation chambers 240 and 260 fragment some of the precursor ions. Precursor ions and fragments thereof then exit the fragmentation chamber. A differential vacuum pumping system can be included that prevents excess collision gas from significantly increasing pressure in the tandem TOF mass spectrometer.

Figure 4:
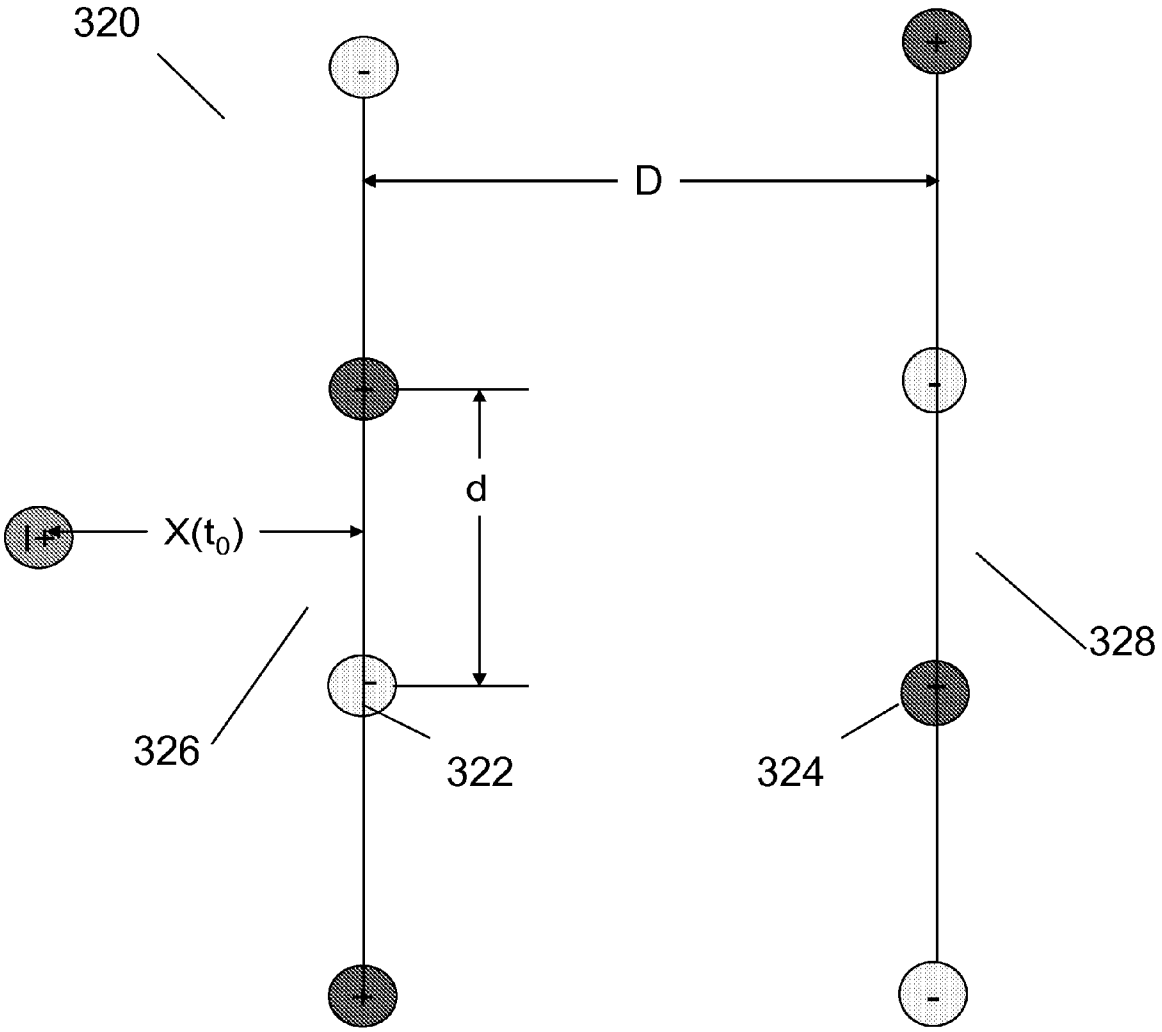
FIG. 4 is a schematic representation of one embodiment of a high resolution timed ion selector according to the present teaching that uses a pair of Bradbury-Nielsen type ion shutters or gates.

FIG. 4 is a schematic representation of one embodiment of a high resolution timed ion selector 320 according to the present teaching that uses a pair of Bradbury-Nielsen type ion shutters or gates. A Bradbury-Nielsen type ion shutter or gate is an electrically activated ion gate. Bradbury-Nielsen timed ion selectors include parallel wires that are positioned orthogonal to the path of the ion beam. High-frequency voltage waveforms of opposite polarity are applied to alternate wires in the gate. The gates only pass charged particles at certain times in the waveform cycle when the voltage difference between wires is near zero. At other times, the ion beam is deflected to some angle by the potential difference established between the neighboring wires. The wires are oriented so that ions rejected by the timed ion selectors are deflected away from the exit aperture.

The deflection of ions is proportional to the distance of the ions from the plane of the entrance aperture at the time the polarity switches. The mass resolving power can be adjusted by varying the amplitude of the voltage applied to the wires and is only weakly affected by the speed of the transition. In one embodiment where precise measurements are required, a power supply provides the wires of the Bradbury-Nielsen ion selector with an amplitude of approximately +/−500 volts with a 7 nsec switching time.

In the embodiment depicted in FIG. 4, the timed ion selector 320 comprises a first Bradbury-Nielson gate 326 and a second Bradbury-Nielson gate 328 separated by a small distance D. The Bradbury-Nielson gates are formed from wires with a radius R separated by a distance d. In one specific embodiment, d=1 mm, R=0.05 mm, and D=2 mm. The Bradbury-Nielson gates are closed so that ions are rejected when equal and opposite polarity voltages are applied to adjacent wires in the Bradbury-Nielson gate. The two Bradbury-Nielson gates are accurately aligned so that negatively charged wires 322 in the first gate 326 are accurately aligned with positively charged wires 324 in the second gate 328.

Figure 5:
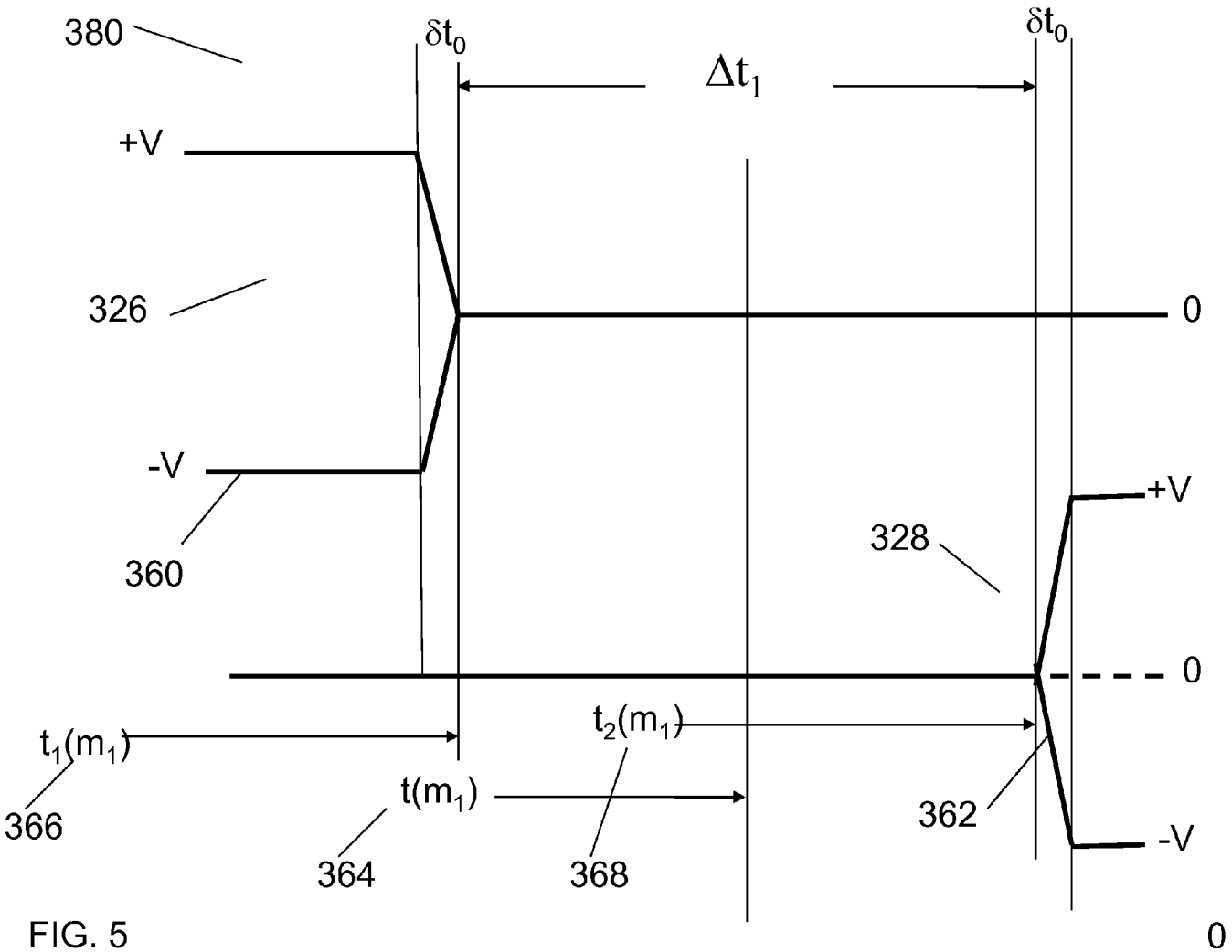
FIG. 5 presents a plot of exemplary voltage waveforms that are applied to the Bradbury-Nielsen timed ion selector in a TOF-TOF mass spectrometer with high resolution precursor selection of a first m/z value in multiplexed MS-MS operation according to the present teaching.

FIG. 5 presents a plot 380 of exemplary voltage waveforms 360 and 362 that are applied to the Bradbury-Nielsen timed ion selector in a TOF-TOF mass spectrometer with high resolution precursor selection of a first m/z value in multiplexed MS-MS operation according to the present teaching. According to one embodiment of the present teaching, separate power supplies are used to provide the waveforms 360 and 362 for each gate. Before the first precursor ion $m_1$ approaches for selection, the first gate 326 is closed and the second gate 328 is open. At time $t_1(m_1)$ 366, the first precursor ion with mass $m_1$ reaches a predetermined position relative to the plane of first gate 326. At time $t_1(m_1)$ 366, the first gate 326 is opened and mass $m_1$ is transmitted to second gate 328. At time $t_2(m_1)$ 362, the mass $m_1$ has travelled a predetermined distance past the plane of second gate 328 and at time $t_2(m_1)$ 362, the second gate 328 is closed. Thus, ions of lower mass than the selected mass $m_1$ are rejected by the first gate 326 and ions of higher mass than the selected mass $m_1$ are rejected by second gate 328. The Bradbury-Nielsen gates remain in this state with the first gate 326 open and the second gate 328 closed until the next higher predetermined mass $m_2$ approaches the first gate 326.

Figure 6:
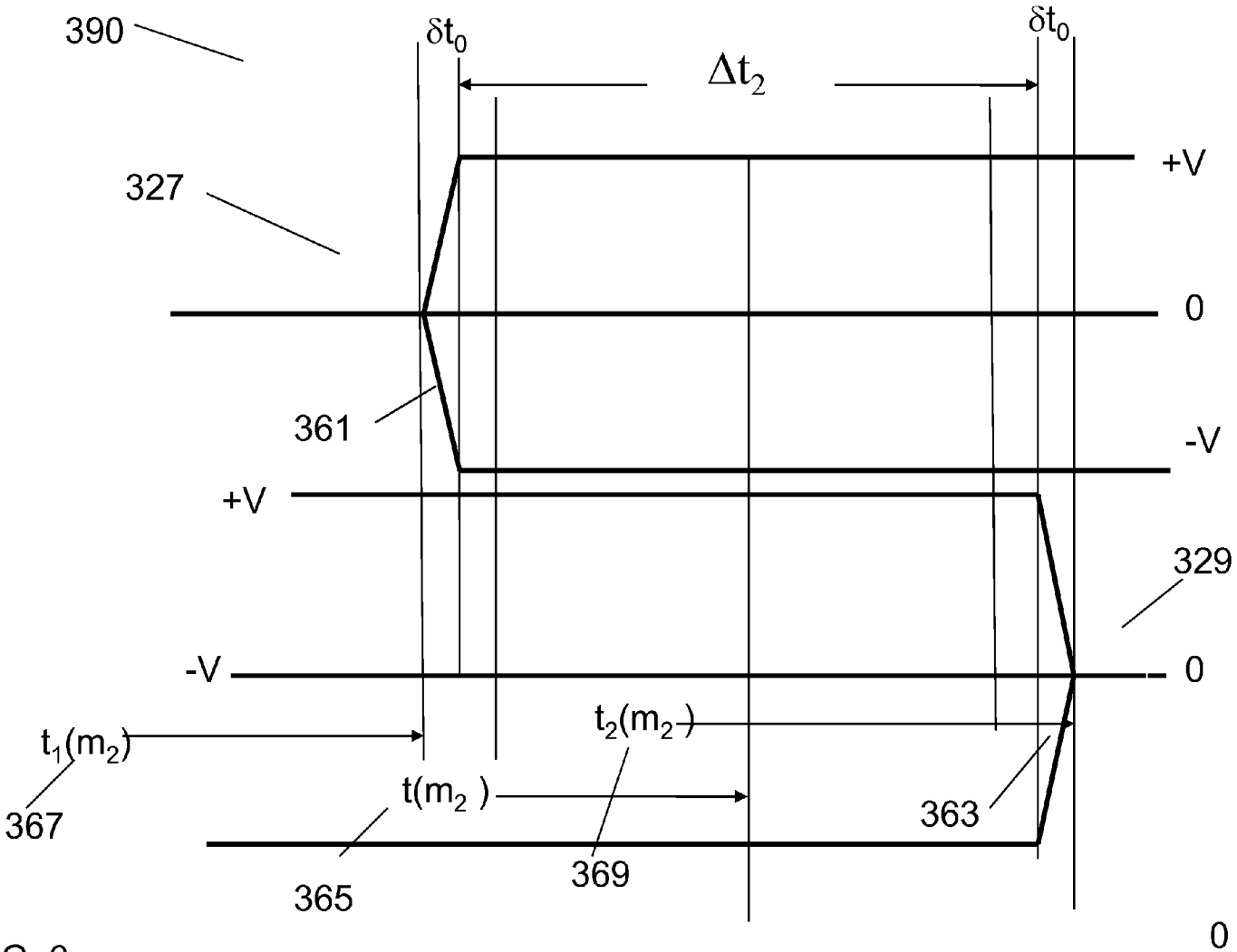
FIG. 6 presents a plot of exemplary voltage waveforms that are applied to the Bradbury-Nielsen timed ion selector in a TOF-TOF mass spectrometer with high resolution precursor selection of a second m/z value in multiplexed MS-MS operation according to the present teaching.

FIG. 6 presents a plot 390 of exemplary voltage waveforms 361 and 363 that are applied to the Bradbury-Nielsen timed ion selector in a TOF-TOF mass spectrometer with high resolution precursor selection of a second m/z value in multiplexed MS-MS operation according to the present teaching. At time $t_1(m_2)$ 367, the second precursor ion with mass $m_2$ reaches a predetermined position past the plane of first gate 327. Also, at time $t_1(m_2)$ 367, the first gate 327 is closed and mass $m_1$ is transmitted to the second gate 329. At time $t_2(m_2)$ 369, mass $m_2$ has travelled a predetermined distance less than the distance to the plane of the second gate 329. Also at time $t_2(m_2)$ 369, the second gate 329 is opened. Thus, ions of higher mass than the selected mass $m_2$ are rejected by the first gate 327 and ions of lower mass than the selected mass $m_2$ are rejected by second gate 329. The Bradbury-Nielsen gates remain in this state with the first gate 327 closed and the second gate 329 open until the next higher predetermined mass $m_3$ approaches the first gate 327. Multiple mass peaks can be selected if the arrival times differ by at least the minimum time required for the power to execute one full cycle.

Referring also to FIG. 3, the flight time of an ion at position 312 in the pulsed ion accelerator at the time that the pulsed acceleration $V_p$ is applied to a position 228 is equal to the effective distance between position 312 and the position 228 divided by the velocity of the ion. If the effective distance from the position 312 in the pulsed accelerator to the midpoint between selectors 327 and 329 is $D_e$, then the effective distance to the point $x_1$ is $D_e-D/2+x_1$. Note that $x_1$ is negative. The effective distance to the point $x_2$ is $D_e+D/2+x_2$. Thus $t_1(m_1)=t(m_1)\{[1-[(D/2)+x_1]/D_e\}$ and $t_2(m_1)=t(m_1)\{[1+[(D/2)+x_2]/D_e\}$. Similarly $t_1(m_2)=t(m_2)\{[1-[(D/2)-x_1]/D_e\}$ and $t_2(m_2)=t(m_1)\{[1+[(D/2)+x_2]/D_e\}$. Note that $x_1$ is negative and $x_2$ positive for $m_1$ and $x_1$ is positive and $x_2$ is negative for $m_2$.

The equations for calculating the performance of a single Bradbury-Nielsen type timed ion selector are known. Deflection angle can be determined from the following equation assuming that the voltage is turned on when the ion is at position $x_0$ and then turned off when the ion is at position $x_1$ relative to the plane of the gate:

$$\tan\alpha(x_0,x_1)=k(V_p/V_0)[(2/\pi)\tan^{-1}(\{\exp((\pi x_1/d_e)\}-(2/\pi)\tan^{-1}\{\exp(\pi x_0/d_e)\}],$$

where k is a deflection constant given by $k=\pi\{2\ln[\cot(\pi R/2d)]\}^{-1}$, $V_p$ is the deflection voltage ($+V_p$ on one wire set, $-V_p$ on the other), $V_0$ is the accelerating voltage of the ions, and $d_e$ is the effective wire spacing given by $d_e=d\cos[(\pi(d-2R)/4d]$, where d is the distance between wires and R is the radius of the wire. The angles are expressed in radians.

For this calculation, the origin for the ion travel along the x axis is located at the plane of the selector. Thus, ions approaching the Bradbury-Nielsen type timed ion selectors are located at a negative x position and ions leaving the Bradbury-Nielsen type timed ion selectors are located at a positive x position. For continuous application of the deflection voltage, $x_0$ goes to negative infinity, and $x_1$ goes to positive infinity. Thus, for a continuous deflection voltage, the deflection angle can be expressed by the following equation:

$$\tan\alpha_{max}=2k(V_p/V_0).$$

High resolution selection using a dual Bradbury-Nielson gate as depicted in FIG. 4 requires a timing sequence different from that employed with a single gate. In this device, the deflection voltage for the first gate 326 (FIG. 4) is initially on and is turned off when the first selected ion is at negative distance $x_1$ from the plane of selector. The deflection angle for the first gate 326 is given by the following equation:

$$\tan\alpha=2k(V_p/V_0))[1-(2/\pi)\tan^{-1}(\{\exp((\pi x_1/d)\}].$$

The deflection voltage for the second gate 328 (FIG. 4) is initially turned off and is turned on when the first selected ion is at positive position $x_2$. The deflection angle for second gate 328 is given by the following equation:

$$\tan\alpha=-2k(V_p/V_0)[(2/\pi)\tan^{-1}(\{\exp((\pi x_2/d_e)\}-1].$$

Deflection by second gate 328 (FIG. 4) is in the opposite direction as deflection by first gate 326 (FIG. 4). The dual Bradbury-Nielson gate provides the performance needed for high resolution selection of a large number of precursor ions for multiplex operation of the tandem TOF mass spectrometer. After selection of the first selected ion, the deflection voltage for first gate 326 is turned off and the deflection voltage for second gate 328 is turned on. The deflection voltage for the first gate 326 is turned on when the second selected ion is at positive distance $x_1$ from the plane of first gate 326 and the second gate 328 is turned off when the second selected ion is at a negative distance $x_2$ from the plate of second gate 328. The net deflection angles for the second selected ion are substantially the same as for the first selected ion. Any number of ions may be selected by the dual Bradbury-Nielson gate. The third, fifth, etc. selected ions employ the same time sequences as for the first selected ion. The fourth, sixth, etc. selected ions employ the same time sequence as for the second selected ion.

Figure 7:
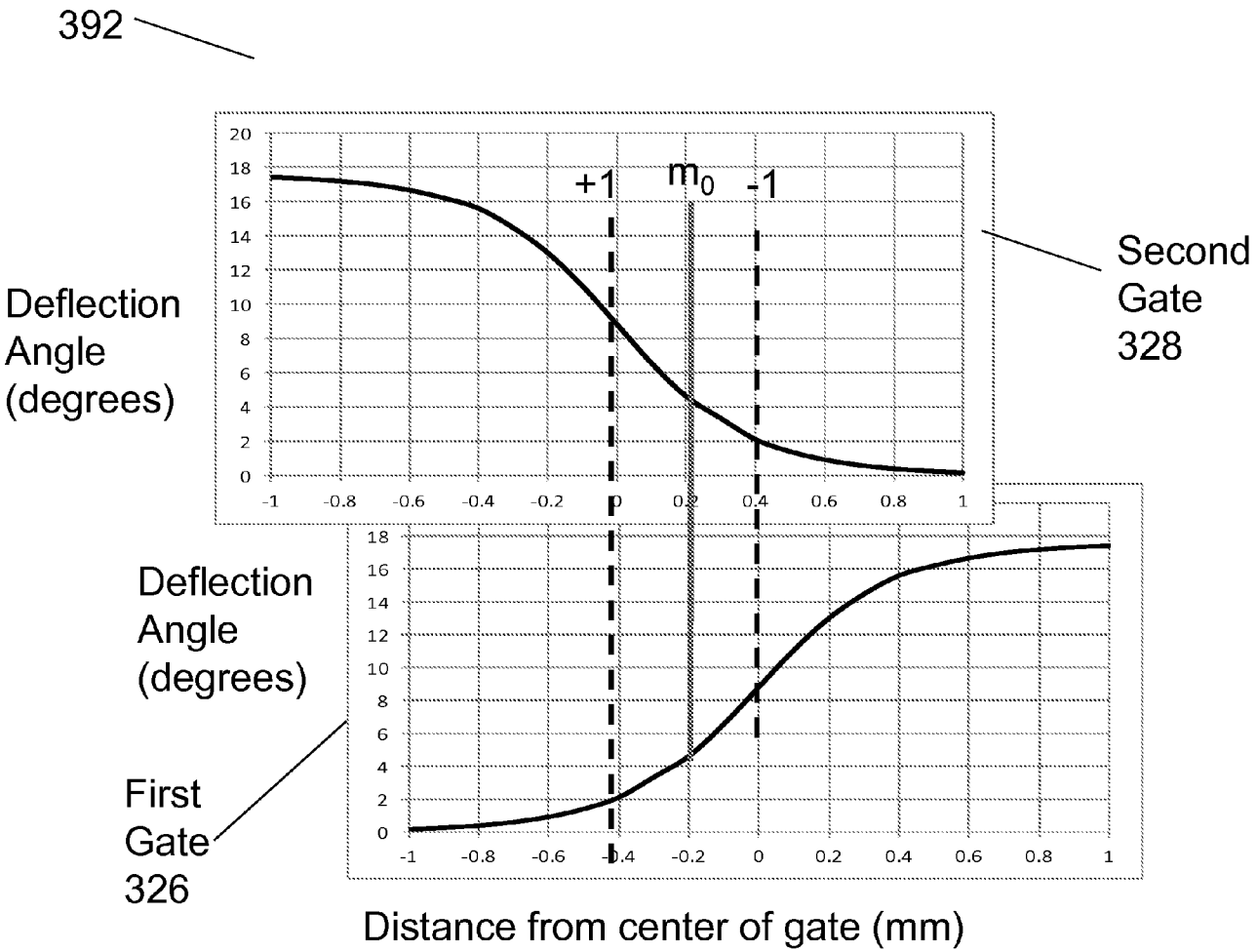
FIG. 7 presents a graph of calculated deflection angle as a function of deflection distances for a Bradbury-Nielsen timed ion selector in a mass spectrometer according to the present teaching that is capable of high resolution precursor selection.

FIG. 7 presents a graph 392 of calculated deflection angle as a function of deflection distances for a Bradbury-Nielsen timed ion selector in a mass spectrometer according to the present teaching that is capable of high resolution precursor selection. The graph 392 is the calculated deflection angle as a function of distance from the center of the gate at a time when the deflection voltage for the first gate is turned off and when the deflection voltage the second gate is turned on. The deflection distances were calculated using the above equations for a mass-to-charge ratio equal to 2,000. The calculations were performed for the parameters d=1 mm, R=0.05 mm, $V_0$=2 kV, $m_0$=2000 Da, k=0.62, $d_{eff}/d$=0.76, $V_p$=500 volts, and $D_e$=800 mm. The deflection distances are average deflection distances in one direction. There is a corresponding second beam deflected by a similar amount in the opposite direction. The deflection distance depends on the trajectory of the incoming ion relative to the wires in the ion selector. It is known that the total variation in deflection distance due to the initial y position is about +/−10% of the average deflection difference.

As illustrated in FIG. 7, the first gate 326 (FIG. 4) is opened when mass $m_0$ is approaching the gate 326 (FIG. 4) and is at position $x_1$=−0.2 mm and second gate 328 (FIG. 4) is closed when mass $m_0$ is at position $x_2$=0.2 mm past the plane of second gate 328. The distance between adjacent masses is equal to the effective distance $D_e$ from the ion source to the ion gate divided by twice the nominal mass $m_0$. Thus, for $m_0$=2,000 Da, the distance between adjacent masses is 0.2 mm. Thus, mass $m_0$+1=2,001 Da is at $x_1$=−0.2 mm and $x_2$=0 mm. Similarly for $m_0-1=1999$ Da, $x_1=0.0$ mm and $x_2=0.2$ mm. The net deflection angle is the difference between the deflection angles for the first gate 326 and the deflection angle for the second gate 328.

Figure 8:
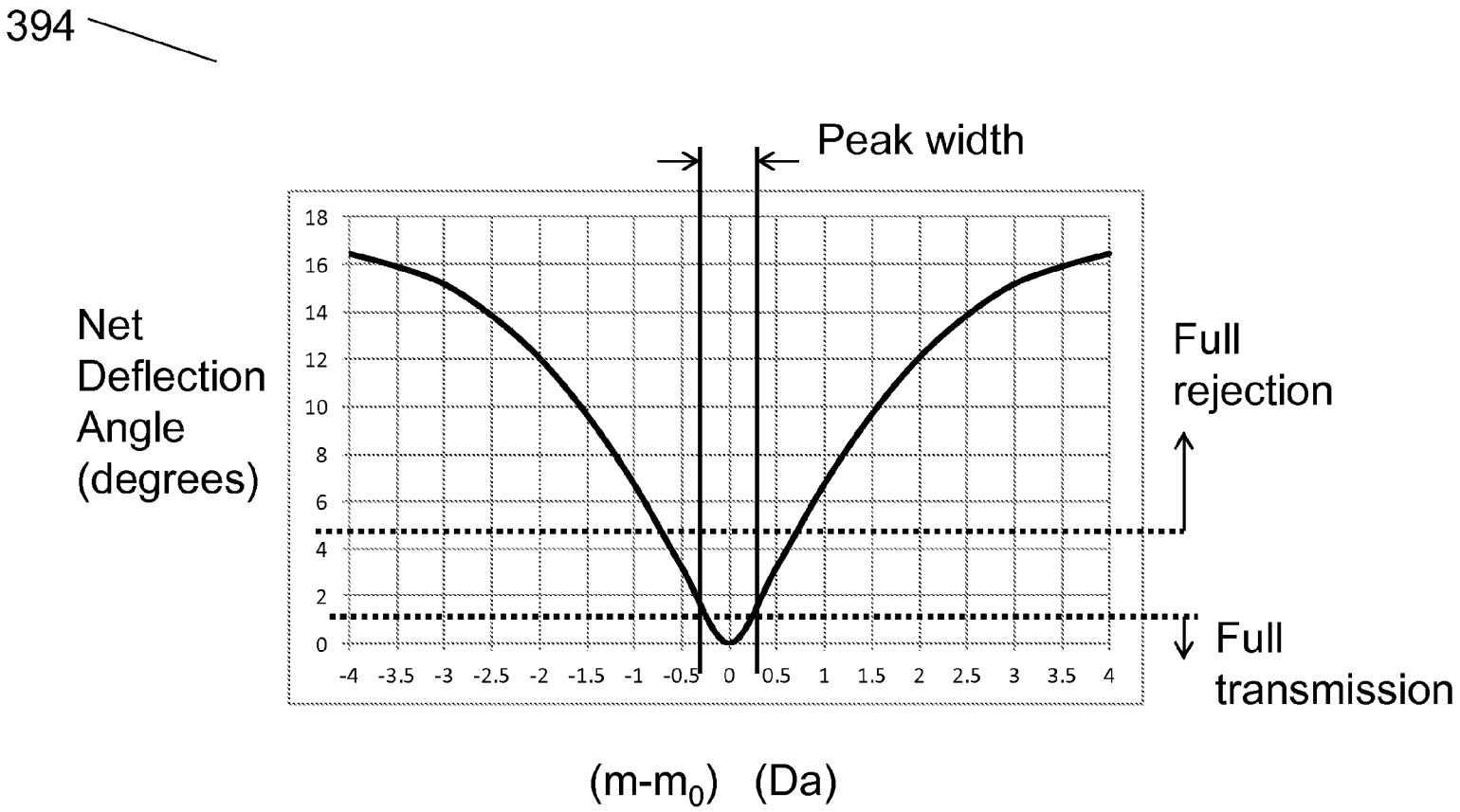
FIG. 8 presents a graph of net deflection angle as a function of mass difference $m-m_0$ (Da) relative to the mass $m_0$ of the selected ion.

FIG. 8 presents a graph 394 of net deflection angle as a function of mass difference $m-m_0$ (Da) relative to the mass $m_0$ of the selected ion. The net deflection angle for the selected ion $m_0$ is substantially zero and the net deflection for $m_0+/-1$ is approximately 6.7 degrees. In one embodiment, a deflection angle greater than 4.8 degrees assures that no significant number of the deflected ions are transmitted. On the other hand, ions deflected by less than 1.2 degrees are transmitted with substantially 100% efficiency. Referring back to FIGS. 2 and 4, one embodiment of the first time-of-flight mass spectrometer 200 provides a resolving power substantially greater than 5,000 at the focal plane 228 that is located nominally at the midpoint between first ion gate 326 (FIG. 4) and the second ion gate 328 (FIG. 4). The width of a peak at focal plane 228 is equal to the effective distance $D_e$ divided by twice the resolving power. Thus, the width of the peak at focal plane 228 is substantially less than 0.07 mm. Thus, the deflection angle for selected ions is less than 1 degree and consequently substantially 100% of selected ions are transmitted.

Figure 9:
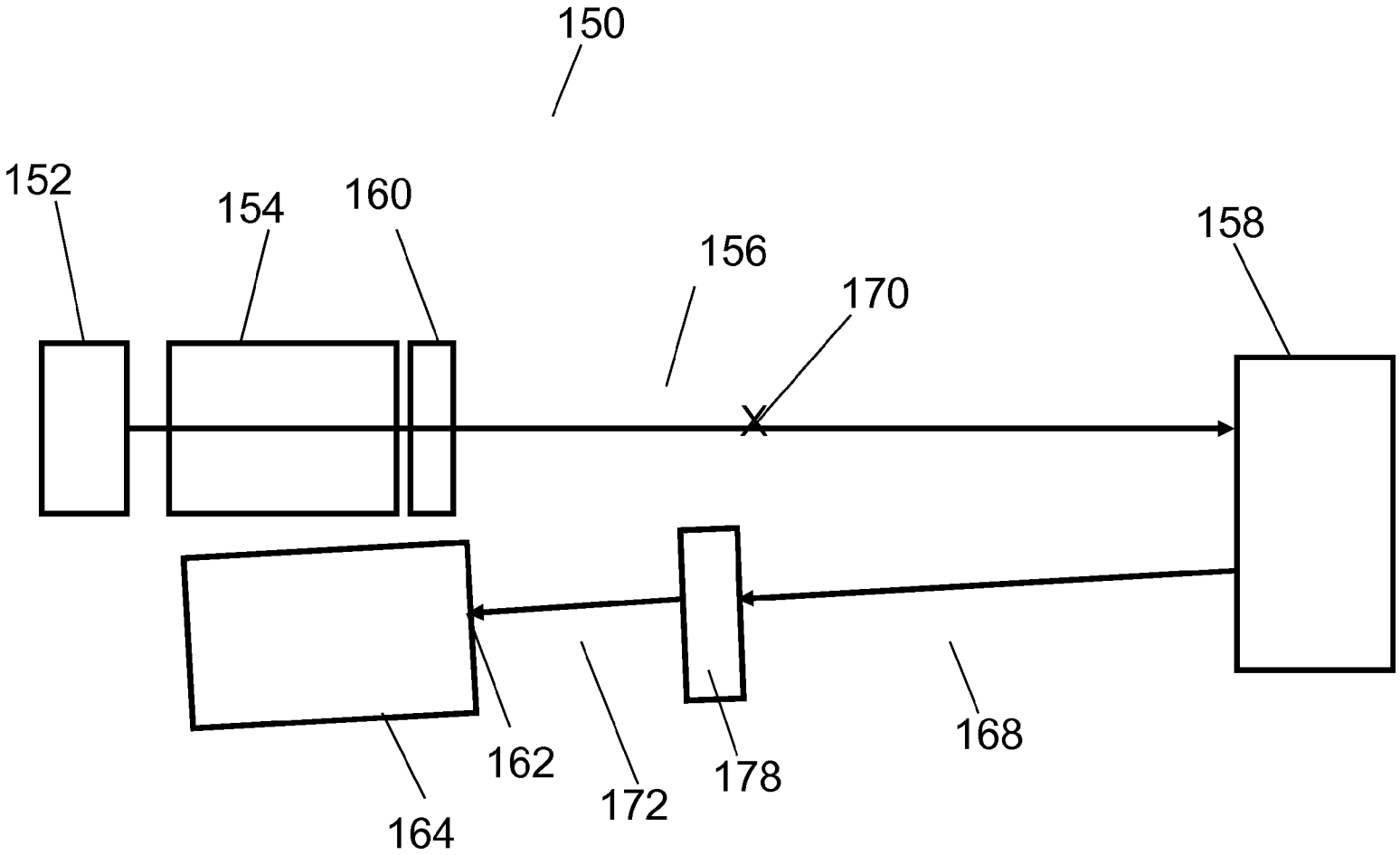
FIG. 9 shows a block diagram of another embodiment of a first stage of the tandem time-of-flight mass spectrometer that includes an ion mirror according to the present teaching.

FIG. 9 shows a block diagram of another embodiment of a first time-of-flight mass analyzer 150 that includes an ion mirror according to the present teaching. This embodiment comprises an ion source 152 generating a pulse of ions, a pulsed ion accelerator 154, a low resolution timed ion selector 160, a first field-free drift space 156, an ion mirror 158, a second field-free drift space 168, a high resolution timed ion selector 178, and a third field-free drift space 172. The entrance 162 to the second time-of-flight mass analyzer 164 is located at the distal end of the field-free space 172. The low resolution timed ion selector 160 transmits a range of masses accelerated in the pulsed accelerator 154 and rejects all others. Ions produced in the pulsed ion source 152, accelerated in pulsed accelerator 154 and selected by low resolution timed-ion selector 160 are focused at focal point 170 in the first field-free drift space 156 to provide simultaneous space and velocity focusing for an ion of predetermined mass-to-charge ratio at focal point 170, and also to minimize the focusing error for ions within a predetermined mass range including the focused mass. The ion mirror 158 reflects ions transmitted by the low resolution timed ion selector 160 and refocuses the ions at the high resolution timed ion selector 178. The high resolution timed ion selector 178 is energized to transmit a predetermined set of precursor ions accelerated by the pulsed ion accelerator 154 to the entrance 162 to the second time-of-flight mass analyzer 164.

The first time-of-flight analyzer 150 provides simultaneous space and velocity focusing for an ion of predetermined mass-to-charge ratio at the timed ion selector 178, and also minimizes the focusing error for ions within a predetermined mass range including the focused mass. In some embodiments, the field-free drift spaces 168 and 172 comprise fragmentation chambers wherein ions may fragment spontaneously as the result of internal excitation in the ion source or as the result of excitation by collisions with neutral molecules in field-free spaces 168 or 172. In some embodiments, the pressure in at least one of the field-free regions 168 or 172 is increased to enhance excitation by collisions with neutral molecules. In some embodiments, field-free regions 168 or 172 may be enclosed and differential pumped employed to allow the pressure in these regions to be increased without increasing the pressure in other regions of the tandem mass spectrometer.

The addition of the ion mirror 158 provides a longer flight path between the ion source 152 and the high resolution timed ion selector 178 relative to the flight time between the ion source 208 and the high resolution timed ion selector 228 in the embodiment illustrated in FIG. 2. This increased flight path allows an increase in the resolving power of precursor selection, but may also result in lower sensitivity since fragments produced in field-free regions 232 and 250 are removed from the beam by the ion mirror 158 and consequently are not detected.

Figure 10:
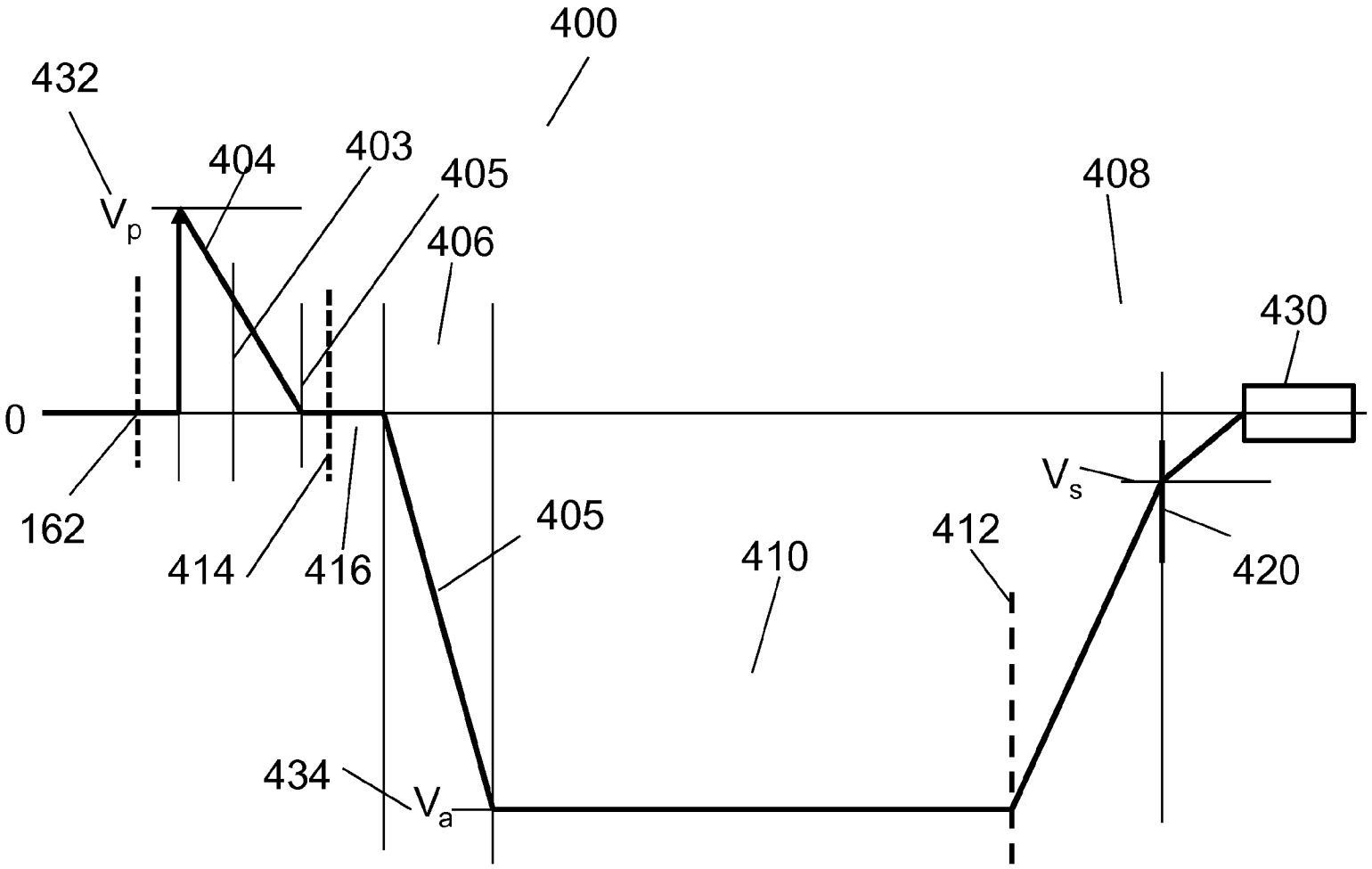
FIG. 10 is a potential diagram for an embodiment of a second stage of the tandem time-of-flight mass spectrometer according to the present teaching.

FIG. 10 is a potential diagram 400 for an embodiment of a second stage time-of-flight mass spectrometer according to the present teaching. In this embodiment a pulsed ion accelerator 404 is positioned adjacent to the entrance 162 of the second stage time-of-flight mass spectrometer. In one embodiment, precursor and fragment ions accelerated by pulsed ion accelerator 404 are further accelerated by a static electric field 405 in region 406. An ion detector 408 is positioned at the end of a second electric field-free region 410. The pulsed potential $V_p$ is applied to the pulsed ion accelerator 404 and the static potential $V_a$ 434 which produces the electric field 405 are chosen such that ions are focused at the ion detector 408. In one embodiment, the ion detector 408 comprises a single channel plate 412 biased at the potential applied to the second field-free region 410, a fast scintillator 420 biased at a more positive potential and a photomultiplier 430 which is at ground potential. The ion detector 408 allows the ions to be efficiently detected at high potential with the signal output at ground potential. The ion detector 408 can be coupled to a transient digitizer, which can perform signal averaging.

When the ions selected by the first time-of-flight mass spectrometer substantially reach the center 403 of the pulsed accelerator 404, an accelerating voltage pulse $V_p$ 432 is applied to the ion accelerator 404. In one embodiment, a timed ion selector 414 is positioned in the field-free region 416 between the exit 405 from the pulsed accelerator 404 and the static accelerating field 406. The timed ion selector 414 is energized to reject fragment ions within a predetermined mass range from each selected precursor ions.

Figure 11:
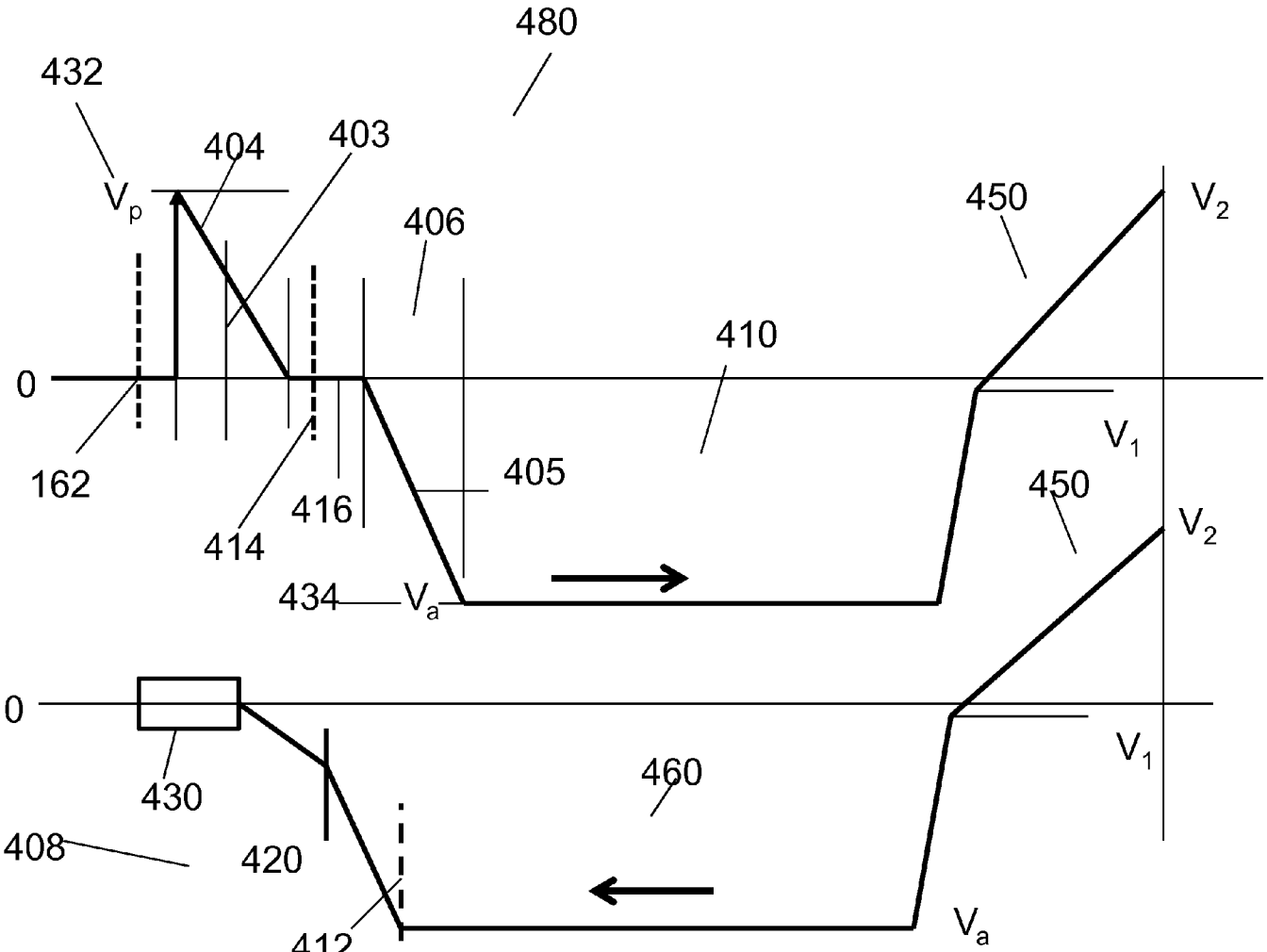
FIG. 11 is a potential diagram for an embodiment of a second stage of a tandem time-of-flight mass spectrometer that includes an ion mirror according to the present teaching.

FIG. 11 is a potential diagram 480 for an embodiment of a second stage of a tandem time-of-flight mass spectrometer that includes an ion mirror according to the present teaching. In this embodiment, an ion mirror 450 is positioned after the first field-free region 410. An ion detector 408 is positioned after the ion mirror 450 in a second electric field-free region 460. The potentials $V_1$ and $V_2$ applied to the ion mirror 450 re-adjusted such that ions reflected by ion mirror 450 are focused at ion detector 408. The addition of ion mirror 450 provides a longer flight path between pulsed ion accelerator 404 and ion detector 408 compared to the flight path in the embodiment illustrated in FIG. 9. This increased flight path allows an increase in the resolving power for spectra of fragment ions but may result in less effective multiplexing since the flight time in MS-2 may be larger compared to the flight time in MS-1.

Figure 12:
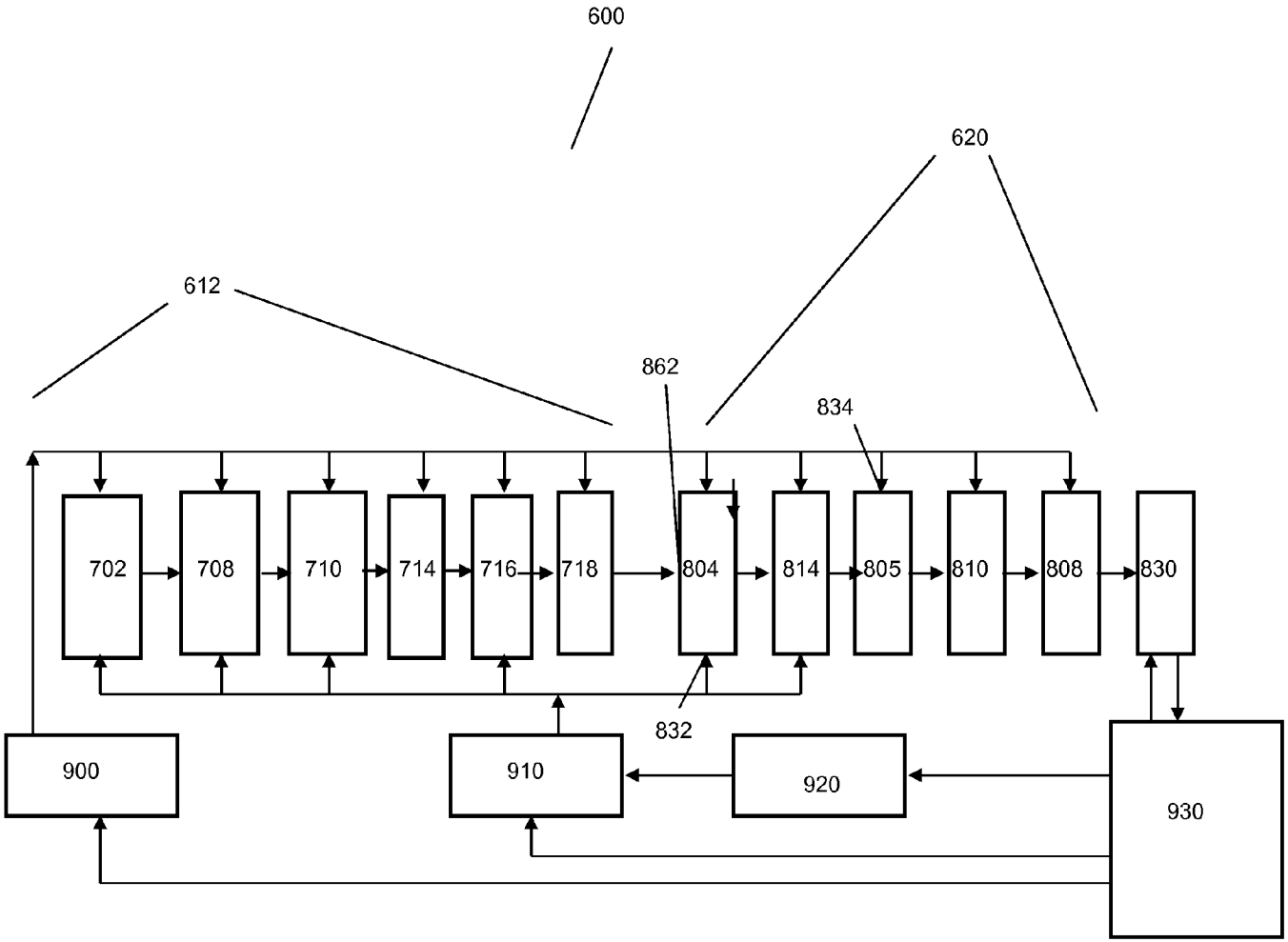
FIG. 12 shows a block diagram of another tandem time-of-flight mass spectrometer according to the present teaching.

FIG. 12 shows a block diagram of another tandem time-of-flight mass spectrometer 600 according to the present teaching. The tandem time-of-flight mass spectrometer 600 performs the following functions; (1) separating precursor ions according to their mass-to-charge ratio; (2) selecting a predetermined set of precursor ions; (3) fragmenting the selected precursor ions; (4) separating fragment ions from each selected precursor ion according to the mass-to-charge ratio of the fragments; and (5) detecting and recording the mass spectra of the fragment ions.

The first time-of-flight mass analyzer 612 comprises an ion source 702, a pulsed ion accelerator 708, a low resolution timed ion selector 710, a first field-free drift space 714, a high resolution timed ion selector 716, and a second field-free drift space 718. The ion source 702 generates a pulse of ions. The pulsed ion accelerator 708 accelerates the pulse of ions. The low resolution timed ion selector 710 transmits a range of masses accelerated in pulsed accelerator 708 and rejects all others. The high resolution timed ion selector 716 transmits a predetermined set of precursor ions accelerated by pulsed ion accelerator 708.

The second stage time-of-flight mass spectrometer 620 according to the present teaching comprises a pulsed ion accelerator 804 positioned adjacent to the entrance 862 of the second stage time-of-flight mass spectrometer 620, a static electric field region 805, a field-free region 810, and an ion detector 808 at the end of region 810. In one embodiment, an ion mirror (not shown) is located in field-free region 810 between the exit from static electric field region 805 and detector 810. A pulsed potential $V_p$ 832 is applied to the pulsed ion accelerator 804 and a static potential $V_a$ 834 is applied to the static electric field region 805. Both the pulsed potential $V_p$ 832 and the static potential $V_a$ 834 are chosen such that ions are focused at the ion detector 808. The ion detector 808 can be electrically connected to a transient digitizer 830, which can perform signal averaging and other signal processing.

When the ions selected by the first time-of-flight mass spectrometer substantially reach the center of the pulsed accelerator 804, the accelerating voltage pulse $V_p$ 832 is applied to the ion accelerator 804. In one embodiment a timed ion selector 814 is positioned between the exit of the pulsed accelerator 804 and the static accelerating field region 805. The timed ion selector 814 is energized to reject fragment ions within a predetermined mass range from each selected precursor ions.

The tandem time-of-flight mass spectrometer 600 according to the present teaching further comprises a static high voltage generator 900, a pulsed high voltage generator 910, and a multiplexed time delay generator 920. In one specific embodiment, the outputs of the generators 900 and 910, the transient digitizer 830, and the time delay generator 920 are controlled by a processor or by a computer 930. The static high voltage generator 900 provides static high voltages (including ground potential) to all the elements comprising the tandem time-of-flight mass spectrometer 600. The magnitude of these voltages is controlled by the computer 930 to an appropriate level that focuses the ions. The computer 930 executes algorithms that calculate the appropriate static and pulsed high voltages and time delays required to focus ions of predetermined mass-to charge ratio. The computer 930 also interfaces with and controls the high voltage generators 900 and 910 and the multiplexed time delay generator 920. The pulsed high voltage generator 910 provides pulsed voltages to the ion source 702, the pulsed accelerator 708, the low resolution timed ion selector 710, the high resolution timed ion selector 716, the pulsed accelerator 804, and the timed ion selector 814. The amplitudes of the pulsed voltages are controlled by computer 930. Computer 930 also programs the multiplexed time delay generator 920 to control the timing of the pulses produced by pulsed high voltage generator 910 as required to accelerate and focus the ions. Signals generated by the digitizer 830 are transmitted to the computer 930 for processing the ion intensities as a function of flight time into calibrated mass spectra. The computer 930 also controls the time and input voltage ranges of digitizer 830.

It should be understood by those skilled in the art that the schematic diagrams shown in the Figures are only schematic representations and that various additional elements would be necessary to complete a functional mass spectrometer according to the present teachings, including power supplies, delay generators, and a vacuum housing. In addition, a vacuum pumping arrangement is required to maintain the operating pressures in the vacuum chamber housing of the mass spectrometer at the desired operating levels. In various embodiments, differential vacuum pumping is employed.

The tandem time-of-flight mass spectrometer according to the present teaching provides high mass resolving power for precursor selection for both MS and MS-MS spectra. In various embodiments, the mass spectrometer can be configured for either positive or negative ions, and can be readily switched from one type of ion to the other type of ions.

Tandem mass spectrometry according to the present teaching provides information on the structure and sequence of many biological polymers and allows unknown samples to be accurately identified. Tandem mass spectrometers according to the present teaching employ a first mass analyzer to produce, separate and select a precursor ion, and a second mass analyzer to fragment the selected ions and record the fragment mass spectrum from the selected precursor. A wide variety of mass analyzers and combinations thereof for use in tandem mass spectrometry can be used with the present teaching. One aspect of the present teaching employs simultaneous space and velocity focusing in a time-of-flight mass spectrometer which allows simultaneous high resolution selection of multiple precursor ions and rapid and accurate determination of masses of fragment ions from selected precursors.

For example, one method for identifying an unknown sample, such as a biological polymer, using a tandem mass spectrometer according to the present invention includes generating an ion beam comprising a plurality of ions. In some methods, the ion beam is generated with MALDI. At least one monoisotopic precursor ion is then selected from the plurality of ions using a first time-of-flight mass spectrometer configured to perform simultaneous space and velocity focusing. In some embodiments, a predetermined portion of the fragment ions from each monoisotopic precursor are selected. At least one of the selected monoisotopic precursor ions is then fragmented. The fragmented selected monoisotopic precursor ions are separated with a second time-of-flight mass analyzer so that a flight time of precursor ions and fragments thereof to a detector is dependent on a mass-to-charge ratio of the selected precursor ions and fragments thereof and is nearly independent of a velocity distribution of the selected precursor ions and fragments thereof. The separated fragmented ions are then detected with a detector and the fragment ion mass spectra are recorded for at least one selected precursor ion. Some methods for identifying an unknown sample according to the present teaching elucidate at least one of a structure and a sequence of the unknown sample.

In one embodiment, single isotopes can be selected and fragmented up to m/z 2500 with no detectable loss in ion transmission and less than 1% contribution from adjacent masses. In some cases ten or more monoisotopic precursor ions can be selected simultaneously and fragmented to produce fragment ions. This allows generation of very high quality MS-MS spectra at unprecedented speed. For example, all of the peptides present in a complex peptide mass fingerprint containing a hundred or more peaks can be fragmented and identified without exhausting the sample by using a mass spectrometer according to the present teaching. Thus, speed and sensitivity of the MS-MS measurements can keep pace with the MS results, and high-quality, interpretable MS-MS spectra can be generated on detected peptides at very low concentrations.

The present teaching employing simultaneous space and velocity focusing provides a method for accurate and sensitive quantization of low levels of selected samples in complex mixtures. Quantitative mass spectrometry generally requires using labeled standards, but unlike other instruments, the method of the present teaching allows simultaneous measurement of multiple components, and the entire fragment spectrum for each can be recorded to improve sensitivity and accuracy. Furthermore, both sample and standard can be acquired at the same time in the same spectrum, and all of the labeled fragments show up as doublets. Quantization is accomplished by measuring the relative intensities of the doublets, thus improving both the accuracy and precision of the measurements since potential interferences are drastically reduced.

For example, a method for quantifying an unknown sample using a tandem mass spectrometer according to the present teaching includes generating an ion beam comprising a plurality of ions and then selecting at least two monoisotopic precursor ion from the plurality of ions using a first time-of-flight mass spectrometer configured to perform simultaneous space and velocity focusing. At least one of the selected precursor ions can be a molecular ion of a known molecule present at a predetermined concentration in the sample. At least two of the selected monoisotopic precursor ions are then fragmented. The fragmented selected monoisotopic precursor ions are separated with a second time-of-flight mass analyzer so that a flight time of precursor ions and fragments thereof to a detector is dependent on a mass-to-charge ratio of the selected precursor ions and fragments thereof and is nearly independent of a velocity distribution of the selected precursor ions and fragments thereof. The separated fragmented ions are detected with a detector and then the fragment ion mass spectra for at least two selected precursor ion is recorded.

Equivalents

While the Applicant's teachings are described in conjunction with various embodiments, it is not intended that the Applicant's teachings be limited to such embodiments. On the contrary, the Applicant's teachings encompass various alternatives, modifications, and equivalents, as will be appreciated by those of skill in the art, which may be made therein without departing from the spirit and scope of the teaching.

What is claimed is:

1. A tandem time-of-flight mass spectrometer comprising:

a. a first time-of-flight mass analyzer that performs a first TOF mass analysis by generating an ion beam comprising a plurality of ions and then selecting a group of precursor ions with predetermined mass-to-charge ratios from the plurality of ions, wherein an ion flight time of the selected group of precursor ions through the first time-of-flight mass analyzer is substantially independent to first order of both an initial position and an initial velocity;

b. an ion fragmentation chamber positioned in the ion flight path of the selected group of precursor ions, the ion fragmentation chamber fragmenting at least one of the selected group of precursor ions accelerated by the ion accelerator; and c. a second time-of-flight mass analyzer positioned in the ion flight path of the selected group of precursor ions, the second time-of-flight mass analyzer performing a second TOF mass analysis by separating the ion fragments and then detecting a fragment ion mass spectrum with a detector, wherein a flight time of precursor ions and fragments thereof to the ion detector is dependent on a mass-to-charge ratio of the selected precursor ions and fragments thereof and is nearly independent of a velocity distribution of the selected precursor ions and fragments thereof.

2. The tandem time-of-flight mass spectrometer of claim 1 wherein the first time-of-flight mass analyzer comprises:

a. an ion source that generates a pulse of ions;

b. a two-field ion accelerator having an input that receives the ions generated by the ion source, the two-field ion accelerator generating an electric field that accelerates the ions generated by the ion source through the ion flight path and causes the ion flight time to a first focal plane in the ion flight path to be independent of an initial position of the ions;

c. a pulsed ion accelerator positioned in the ion flight path after the two-field ion accelerator, the pulsed ion accelerator generating an accelerating electric field that focuses ions of a predetermined mass-to-charge to a second focal plane wherein the ion flight time to the second focal plane is substantially independent to first order of an initial velocity and an initial position of the ions prior to acceleration; and d. a timed ion selector positioned at the focal plane to select and transmit ions of the predetermined mass-to-charge ratio.

3. The tandem time-of-flight mass spectrometer of claim 2 wherein the timed ion selector comprises a pair of Bradbury-Nielson ion gates configured to provide high resolution selection of precursor ions with minimal perturbations of transmitted ions.

4. The tandem time-of-flight mass spectrometer of claim 2 wherein the ion source comprises a MALDI ion source.

5. The tandem time-of-flight mass spectrometer of claim 2 wherein the fragmentation chamber is positioned in a field-free region between the pulsed ion accelerator and the timed ion selector.

6. The tandem time-of-flight mass spectrometer of claim 2 wherein the ion fragmentation chamber is positioned in a field-free region between the timed ion selector and the second time-of-flight mass analyzer.

7. The tandem time-of-flight mass spectrometer of claim 2 further comprising:

a. a static high voltage generator having an output that is electrically connected to at least one of the first time-of-flight mass analyzer, the ion fragmentation chamber, and the second time-of-flight mass analyzer;

b. a pulsed high voltage generator having an output that is electrically connected to the pulsed ion accelerator and an output that is electrically connected to the timed ion selector;

c. a multiplexed time delay generator having an output that is electrically connected to at least one pulsed accelerator, the multiplexed time delay generator controlling a timing of the high voltage pulses generated by the at least one pulsed accelerators; and d. a computer having outputs that are coupled to at least one of the static high voltage generator, the pulsed high voltage generator, and the multiplexed time delay generator, the computer controlling at least one of a magnitude of voltages generated by the static high voltage generator, a magnitude and a repetition rate of pulses generated by the pulsed high voltage generator, and time delays generated by the multiplexed time delay generator.

8. The tandem time-of-flight mass spectrometer of claim 1 wherein the second time-of-flight mass analyzer comprises a second pulsed ion accelerator and an ion detector positioned at a predetermined position in a field-free region adjacent to the second pulsed ion accelerator, the selected precursor ions and fragments thereof from the fragmentation chamber being accelerated by the second pulsed ion accelerator and being directed to the ion detector.

9. The tandem time-of-flight mass spectrometer of claim 8 wherein the second time-of-flight mass analyzer further comprises an ion mirror that is positioned in a path of the selected precursor ions and fragments thereof accelerated by the second pulsed ion accelerator, the ion mirror generating a reflected ion beam that is directed to the ion detector.

10. The tandem time-of-flight mass spectrometer of claim 8 wherein the second time-of-flight mass analyzer further comprises:

a. a second timed ion selector positioned in a path of the selected precursor ions and fragments thereof accelerated by the second pulsed ion accelerator, the second timed ion selector selecting a predetermined portion of the fragment ions from each precursor; and b. a field-free drift space positioned between the second timed ion selector and the ion detector, the field free drift space being biased with a static accelerating field that accelerates the fragment ions from each precursor ion, wherein the ion detector comprises an input surface that is biased at substantially the same potential as the field-free drift space.

11. The tandem time-of-flight mass spectrometer of claim 1 wherein the first time-of-flight mass analyzer comprises:

a. an ion source that generates a pulse of ions;

b. a two-field ion accelerator having an input that receives the ions generated by the ion source, the two-field ion accelerator generating an electric field that accelerates the ions generated by the ion source through the ion flight path and causes the ion flight time to a first focal plane in the ion flight path to be independent of an initial position of the ions;

c. a pulsed ion accelerator positioned in the ion flight path after the two-field ion accelerator, the pulsed ion accelerator generating an accelerating electric field that focuses ions of a predetermined mass-to-charge to a second focal plane wherein the ion flight time to the first focal plane is substantially independent to first order of an initial velocity and an initial position of the ions prior to acceleration;

d. an ion reflector positioned in the ion flight path that focuses ions to a third focal plane where the ion flight time to the third focal plane for an ion of predetermined mass-to-charge ratio is substantially independent to first order of an initial velocity of the ions prior to the acceleration; and e. a timed ion selector positioned at the second focal plane to select and transmit ions of the predetermined mass-to-charge ratio.

12. The tandem time-of-flight mass spectrometer of claim 11 wherein the timed ion selector comprises a pair of Bradbury-Nielson ion gates configured to provide high resolution selection of precursor ions with minimal perturbations of transmitted ions.

13. The tandem time-of-flight mass spectrometer of claim 11 wherein the ion source comprises a MAIDI ion source.

14. The tandem time-of-flight mass spectrometer of claim 11 wherein the fragmentation chamber is located in a field-free region between the ion reflector and the timed ion selector.

15. The tandem time-of-flight mass spectrometer of claim 11 wherein the fragmentation chamber is located in a field-free region between the timed ion selector and the second time-of-flight mass analyzer.

16. The tandem time-of-flight mass spectrometer of claim 11 wherein the second time-of-flight mass analyzer comprises a second pulsed ion accelerator and an ion detector positioned at a predetermined position in a field-free region adjacent to the second pulsed ion accelerator, the selected precursor ions and fragments thereof from the fragmentation chamber being accelerated by the second pulsed ion accelerator and being directed to the ion detector.

17. The tandem time-of-flight mass spectrometer of claim 16 wherein the second time-of-flight mass analyzer further comprises a second ion mirror that is positioned in a path of the selected precursor ions and fragments thereof accelerated by the second pulsed ion accelerator, the second ion mirror generating a reflected ion beam that is directed to the ion detector.

18. The tandem time-of-flight mass spectrometer of claim 11 wherein the second time-of-flight mass analyzer further comprises:

a. a second timed ion selector positioned in a path of the selected precursor ions and fragments thereof accelerated by the second pulsed ion accelerator, the second timed ion selector selecting a predetermined portion of the fragment ions from each precursor; and b. a field-free drift space positioned between the second timed ion selector and the ion detector, the field free drift space being biased with a static accelerating field that accelerates the fragment ions from each precursor ion, wherein the ion detector comprises an input surface that is biased at substantially the same potential as the potential of the field-free drift space.

19. The tandem time-of-flight mass spectrometer of claim 11 further comprising:

a. a static high voltage generator having an output that is electrically connected to the tandem mass spectrometer;

b. a pulsed high voltage generator having an output that is electrically connected to the pulsed ion accelerator and an output that is electrically connected to the timed ion selector;

c. a multiplexed time delay generator having an output that is electrically connected to at least one pulsed accelerator, the multiplexed time delay generator controlling a timing of the high voltage pulses generated by the at least one pulsed accelerators; and d. a computer having outputs that are coupled to at least one of the static high voltage generator, pulsed high voltage generator, and the multiplexed time delay generator, the computer controlling at least one of a magnitude of voltages generated by the static high voltage generator, a magnitude and a repetition rate of pulses generated by the pulsed high voltage generator, and time delays generated by the multiplexed time delay generator.

20. The tandem time-of-flight mass spectrometer of claim 11 further comprising a digitizer for digitizing time-of-flight spectra.

21. A method for identifying an unknown sample using a tandem mass spectrometer, the method comprising:

a. generating an ion beam comprising a plurality of ions;

b. selecting at least one monoisotopic precursor ion from the plurality of ions using a first time-of-flight mass spectrometer configured to perform simultaneous space and velocity focusing;

c. fragmenting at least one of the selected monoisotopic precursor ions;

d. separating the fragmented selected monoisotopic precursor ions with a second time-of-flight mass analyzer so that a flight time of precursor ions and fragments thereof to a detector is dependent on a mass-to-charge ratio of the selected precursor ions and fragments thereof and is nearly independent of a velocity distribution of the selected precursor ions and fragments thereof;

e. detecting the separated fragmented ions with the detector; and f. recording the fragment ion mass spectra for at least one selected precursor ion.

22. The method of claim 21 wherein the generating the ion beam comprises generating an ion beam with MALDI.

23. The method of claim 21 wherein the unknown sample comprises a biological polymer.

24. The method of claim 21 wherein the selecting one or more monoisotopic precursor ions comprises selecting a predetermined portion of the fragment ions from each monoisotopic precursor.

25. The method of claim 21 wherein the method comprises elucidating at least one of a structure and a sequence of the unknown sample.

26. A method for quantifying an unknown sample using a tandem mass spectrometer, the method comprising:

a. generating an ion beam comprising a plurality of ions;

b. selecting at least two monoisotopic precursor ion from the plurality of ions using a first time-of-flight mass spectrometer configured to perform simultaneous space and velocity focusing;

c. fragmenting at least two of the selected monoisotopic precursor ions;

d. separating the fragmented selected monoisotopic precursor ions with a second time-of-flight mass analyzer so that a flight time of precursor ions and fragments thereof to a detector is dependent on a mass-to-charge ratio of the selected precursor ions and fragments thereof and is nearly independent of a velocity distribution of the selected precursor ions and fragments thereof;

e. detecting the separated fragmented ions with the detector; and f. recording the fragment ion mass spectra for at least two selected precursor ion.

27. The method of claim 26 wherein at least one of the selected precursor ions comprise a molecular ion of a known molecule present at a predetermined concentration in the sample.

28. The method of claim 26 further comprising determining a concentration of the molecule corresponding to a selected precursor by comparing intensities of fragment ions from the selected precursor to intensities of predetermined fragment ions from known molecules.

* * * * *